US012570336B2

(12) United States Patent
Roe et al.

(10) Patent No.: US 12,570,336 B2
(45) Date of Patent: Mar. 10, 2026

(54) SYSTEM FOR DETECTING DEFECTS IN RAIL AND METHODS OF USING SAME

(71) Applicant: Herzog Services, Inc., St. Joseph, MO (US)

(72) Inventors: Jason Roe, St. Joseph, MO (US); Brent T. Applebury, St. Joseph, MO (US); Andy White, Savannah, MO (US); John W. Kieser, Platte City, MO (US)

(73) Assignee: Herzog Services, Inc., St. Joseph, MO (US)

( * ) Notice: Subject to any disclaimer, the term of this patent is extended or adjusted under 35 U.S.C. 154(b) by 425 days.

(21) Appl. No.: 18/355,392

(22) Filed: Jul. 19, 2023

(65) Prior Publication Data

US 2024/0025461 A1 Jan. 25, 2024

Related U.S. Application Data

(60) Provisional application No. 63/368,829, filed on Jul. 19, 2022.

(51) Int. Cl.
*B61K 9/08* (2006.01)
*B61K 9/02* (2006.01)

(52) U.S. Cl.
CPC . *B61K 9/08* (2013.01); *B61K 9/02* (2013.01)

(58) Field of Classification Search
CPC ..... B61K 9/02; B61K 9/08
USPC ..... 33/523.1
See application file for complete search history.

(56) References Cited

U.S. PATENT DOCUMENTS

| | | | |
|---|---|---|---|
| 665,465 | A | 1/1901 | Prentice |
| 2,062,801 | A | 12/1936 | Augustin |
| 3,263,628 | A | 8/1966 | Grove et al. |
| 3,645,211 | A | 2/1972 | Gretzschel et al. |
| 4,044,594 | A | 8/1977 | Owens et al. |
| 4,075,888 | A | 2/1978 | Buhler |
| 4,391,134 | A | 7/1983 | Theurer et al. |

(Continued)

FOREIGN PATENT DOCUMENTS

| | | | |
|---|---|---|---|
| CN | 111337574 | A | 6/2020 |
| CN | 111547086 | A | 8/2020 |

(Continued)

OTHER PUBLICATIONS

Sperry Rail Service, Sperry B-Scan Dual Rail Inspection System; pp. 1-4; published prior to Nov. 26, 2014.

(Continued)

*Primary Examiner* — George B Bennett
(74) *Attorney, Agent, or Firm* — AVEK IP, LLC; Kent R. Erickson

(57) ABSTRACT

A rail testing system comprises a proximal mobile track system and a distal mobile track system. Each of the proximal mobile track system and the distal mobile track system are movable in a horizontal direction and a vertical direction. A carriage is movably coupled to the proximal mobile track system and the distal mobile track system. The system has a sensor pod comprising a roller search unit. The sensor pod is configured to lock to the carriage for testing of a rail. The system includes a sensor array comprising time of flight sensors. The sensor array is usable to maintain an alignment of the roller search unit with the rail.

21 Claims, 25 Drawing Sheets

(56) References Cited

U.S. PATENT DOCUMENTS

| | | | | |
|---|---|---|---|---|
| 4,468,966 | A | 9/1984 | Bradshaw | |
| 4,689,995 | A | 9/1987 | Turbe | |
| 5,660,115 | A | 8/1997 | Shimon et al. | |
| 5,756,903 | A | 5/1998 | Norby et al. | |
| 5,804,731 | A | 9/1998 | Jaeggi | |
| 5,867,404 | A * | 2/1999 | Bryan | B61L 23/048 714/724 |
| 5,970,438 | A | 10/1999 | Clark et al. | |
| 6,476,603 | B2 | 11/2002 | Clark et al. | |
| 6,516,668 | B2 | 2/2003 | Havira et al. | |
| 6,600,999 | B2 | 7/2003 | Clark et al. | |
| 6,981,419 | B1 | 1/2006 | Hay et al. | |
| 6,988,451 | B2 | 1/2006 | Marcotte et al. | |
| 7,201,106 | B2 | 4/2007 | Whiston et al. | |
| 7,389,694 | B1 | 6/2008 | Hay et al. | |
| 7,516,662 | B2 | 4/2009 | Nielsen et al. | |
| 7,849,748 | B2 | 12/2010 | Havira | |
| 7,882,742 | B1 | 2/2011 | Martens | |
| 8,424,387 | B2 | 4/2013 | Wigh et al. | |
| 8,820,166 | B2 | 9/2014 | Wigh et al. | |
| 8,863,670 | B2 | 10/2014 | Jackson | |
| 9,010,186 | B2 | 4/2015 | Pagano | |
| 9,562,878 | B2 | 2/2017 | Graham et al. | |
| 9,950,716 | B2 | 4/2018 | English et al. | |
| 10,093,326 | B2 * | 10/2018 | Glinka | B61L 27/04 |
| 10,168,304 | B2 | 1/2019 | Prince et al. | |
| 10,737,710 | B2 * | 8/2020 | Rosenberger | B61L 23/044 |
| 10,739,311 | B2 * | 8/2020 | Kawabata | G01N 27/72 |
| 10,913,466 | B2 | 2/2021 | Kocur et al. | |
| 10,989,692 | B2 | 4/2021 | English et al. | |
| 11,590,992 | B2 | 2/2023 | Kim et al. | |
| 2001/0032513 | A1 | 10/2001 | Havira et al. | |
| 2011/0209549 | A1 | 9/2011 | Kahn | |
| 2012/0218868 | A1 | 8/2012 | Kahn et al. | |
| 2014/0069193 | A1 | 3/2014 | Graham et al. | |
| 2014/0261067 | A1 | 9/2014 | Davis | |
| 2022/0073113 | A1 * | 3/2022 | Chung | G01B 11/0691 |
| 2024/0059330 | A1 * | 2/2024 | Yu | B61K 9/08 |

FOREIGN PATENT DOCUMENTS

| | | | |
|---|---|---|---|
| CN | 212459523 | U | 2/2021 |
| WO | 2022141370 | A1 | 7/2022 |

OTHER PUBLICATIONS

Sperry Rail Service, Sperry Railbound Inspection Vehicles; pp. 1-8; published prior to Nov. 26, 2014.

Sperry Rail Service, The Sperry 450 Series Hi-Rail Detector Cars; pp. 1-4; published prior to Nov. 26, 2014.

Sperry Rail Service, The Sperry 7000 Series; pp. 1-6; published prior to Nov. 26, 2014.

Sperry Rail Service, The Sperry BSFD Trolley brochure; pp. 1-4; published prior to Nov. 26, 2014.

Sperry Rail Service; The Sperry 950 Series Hi-Rail Detector Cars; pp. 1-4; published prior to Nov. 26, 2014.

* cited by examiner

SYSTEM FOR DETECTING DEFECTS IN RAIL AND METHODS OF USING SAME

CROSS REFERENCE TO RELATED APPLICATIONS

This application claims the benefit of U.S. Provisional Patent Application Ser. No. 63/368,829, entitled SYSTEM FOR DETECTING DEFECTS IN RAIL AND METHODS OF USING SAME, filed Jul. 19, 2022, the disclosure of which is incorporated herein in its entirety by reference.

BACKGROUND OF THE INVENTION

Field of the Invention

The present invention relates generally to the field of systems and methods for detecting defects in a structure. More specifically, the present invention relates to ultrasonic systems for detecting defects in railway rails and methods of using same.

BACKGROUND OF THE INVENTION

Rails of railway track systems incur damage as a matter of course. The damage may be caused, e.g., by harsh environmental conditions, heavy loads, and/or prolonged use. It is well documented that defects and fissures in rails result in numerous train accidents every year. It is prudent to timely detect and address such flaws in order to reduce the risk of accidents or further damage to the rails.

Often, these flaws are not visible to the naked eye. Ultrasonic testing, therefore, has been employed to detect flaws and defects in rails. In the prior art, a hi-rail vehicle with flanged rail wheels carries an ultrasonic test unit or carriage along the rails. The carriage applies ultrasonic signals to the rails that provide indications of flaws and defects. The carriage contains roller search units ("RSUs"). Each RSU comprises an ultrasonic sensor system including a fluid-filled wheel and ultrasonic transducers. The fluid-filled wheel is typically formed of a pliant material that deforms to establish a contact surface when the wheel is pressed against the rail, and the ultrasonic transducers are configured and positioned for transmitting ultrasonic beams through the fluid in the wheel and through the contact surface into the rail and for receiving the reflected beams from the rail. One such RSU is described in U.S. Pat. No. 8,424,387, the disclosure of which is incorporated by reference herein in its entirety. The carriage has at least one RSU on both sides thereof so that the two rails can be tested simultaneously using the same carriage.

To ensure that flaws in the rail are appropriately detected using such ultrasonic testing, it is critical that the RSUs remain centered on the rails as the carriage is transported along the rail by the hi-rail vehicle. In the prior art, in addition to the hi-rail vehicle, the carriage transporting the RSUs includes one or more flanged wheels on both sides configured to ride over the rails. The flanged wheels serve to laterally steer and stabilize the carriage along the track. However, due to wear of the railhead (e.g., due to inconsistencies in the wear pattern of the railhead of the left rail relative to the railhead of the right rail), the flanged wheels of the carriage deviate from the center of the rails from time to time, thereby adversely impacting the RSU testing data. The operator therefore has to constantly monitor the carriage to ensure the RSUs remain centered on the rails. When the operator detects a misalignment between an RSU and a rail, the operator is forced to stop the testing, exit the hi-rail vehicle, and recenter the carriage on the rails prior to resumption of the testing. Such repeated stopping and starting of the ultrasonic testing is both laborious and inefficient. RSU testing systems that can guide the RSUs along the rails autonomously or generally autonomously would provide a significant advantage over the prior art.

SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

A rail sensing system moveable along a railway is disclosed for imaging or sensing properties such as flaws of first and second rails of a railway. The system is mountable or mounted on a frame of a hi-rail vehicle and comprises two separate and independently operable sensor positioning systems for deploying and maintaining a rail property sensor in alignment with a center or other portion of a respective rail. The sensor positioning systems are connected to a support structure connected to the hi-rail vehicle frame and may be enclosed in a housing which may be part of the support structure.

A first sensor positioning system is disposed on a left side of the hi-rail vehicle frame and comprises a left vertical track mounted on a left horizontal track. The left horizontal track is connected to the support structure on the left side of the hi-rail vehicle frame. A left vertical track motor operably connected to the left vehicle track moves the left vertical track horizontally relative to the support structure. A carriage is moveably mounted on the left vertical track for vertical movement relative thereto and a carriage motor connected between the left carriage and the left vertical track is operable to mov the left carriage vertically on the left vertical track. A rail property sensor, such as an ultrasonic roller sensor unit may be mounted on a pod frame which may be removable mounted on the carriage mounted on the left vertical track.

A first sensor positioning system is disposed on a left side of the hi-rail vehicle frame and comprises a left vertical track mounted on a left horizontal track. The left horizontal track is connected to the support structure on the left side of the hi-rail vehicle frame. A left vertical track motor operably connected to the left vehicle track moves the left vertical track horizontally relative to the support structure. A carriage is moveably mounted on the left vertical track for vertical movement relative thereto and a carriage motor connected between the left carriage and the left vertical track is operable to mov the left carriage vertically on the left vertical track. A rail property sensor, such as an ultrasonic roller sensor unit may be mounted on a pod frame which may be removable mounted on the carriage mounted on the left vertical track.

A second sensor positioning system is disposed on a right side of the hi-rail vehicle frame and comprises a right vertical track mounted on a right horizontal track. The right horizontal track is connected to the support structure on the right side of the hi-rail vehicle frame. A right vertical track motor operably connected to the right vehicle track moves the right vertical track horizontally relative to the support structure. A carriage is moveably mounted on the right vertical track for vertical movement relative thereto and a carriage motor connected between the right carriage and the right vertical track is operable to mov the right carriage vertically on the right vertical track. A rail property sensor, such as an ultrasonic roller sensor unit may be mounted on a pod frame which may be removable mounted on the carriage mounted on the right vertical track.

A time of flight sensor array may be connected to the left vertical track proximate a lower end thereof. The left time of flight sensor array communicates with a control system and the control system is in communication with and controls the left vertical track motor to move the left vertical track horizontally to maintain a horizontal alignment of the left rolling sensor unit relative to the first rail based upon information transmitted from the left time of flight sensor array to the control system. A right time of flight sensor array is connected to the right vertical track proximate a lower end thereof. The right time of flight sensor array is in communication with a control system and the control system is in communication with and controls the right vertical track motor to move the right vertical track horizontally to maintain a horizontal alignment of the right rolling sensor unit relative to the second rail based upon information transmitted from the right time of flight sensor array to the control system.

BRIEF DESCRIPTION OF THE DRAWINGS

Illustrative embodiments of the present disclosure are described in detail below with reference to the attached drawing figures.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Figure 2:
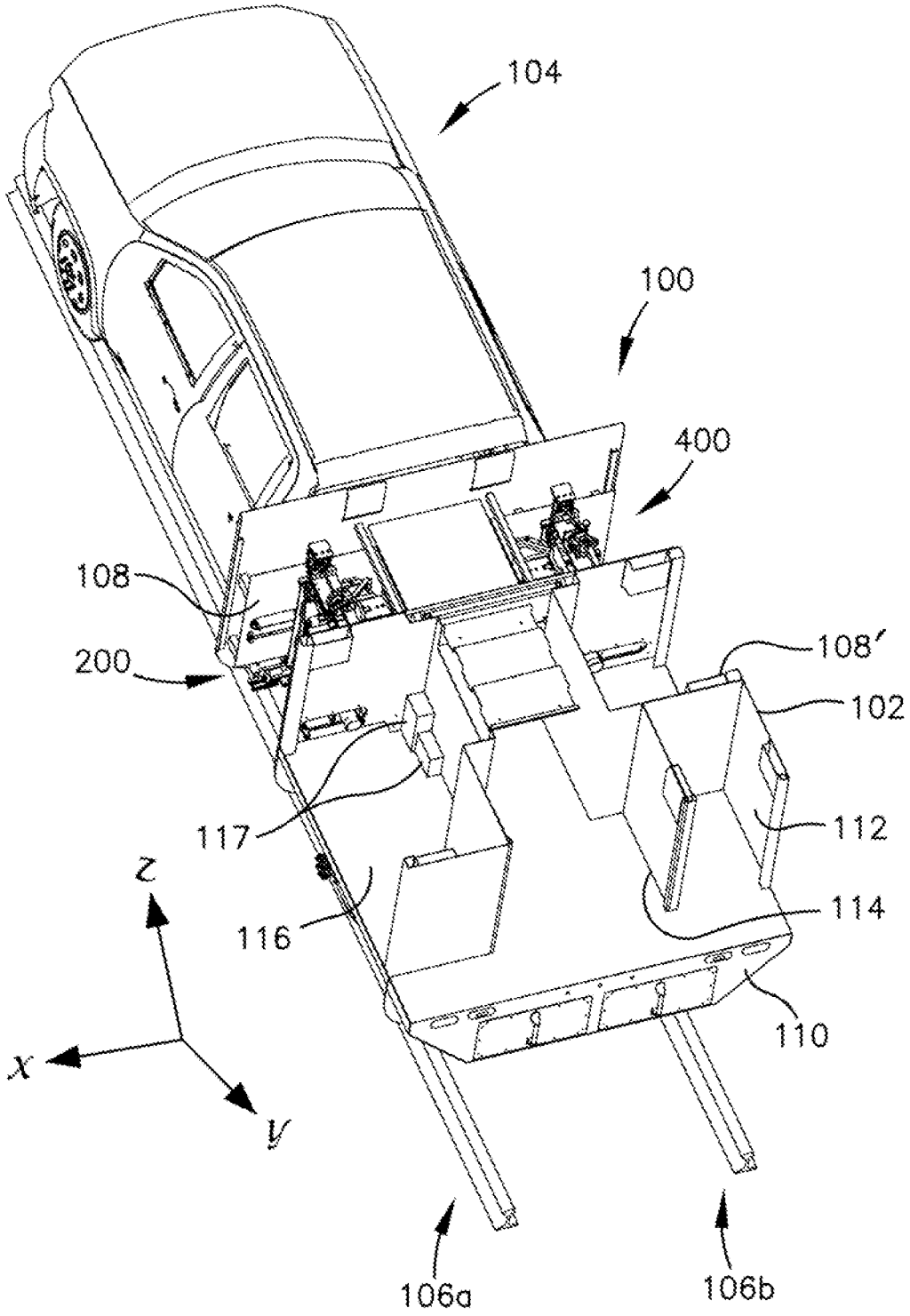
FIG. 2 is a top view of the rail testing system of FIG. 1 with portions of the equipment housing removed
Figure 3:
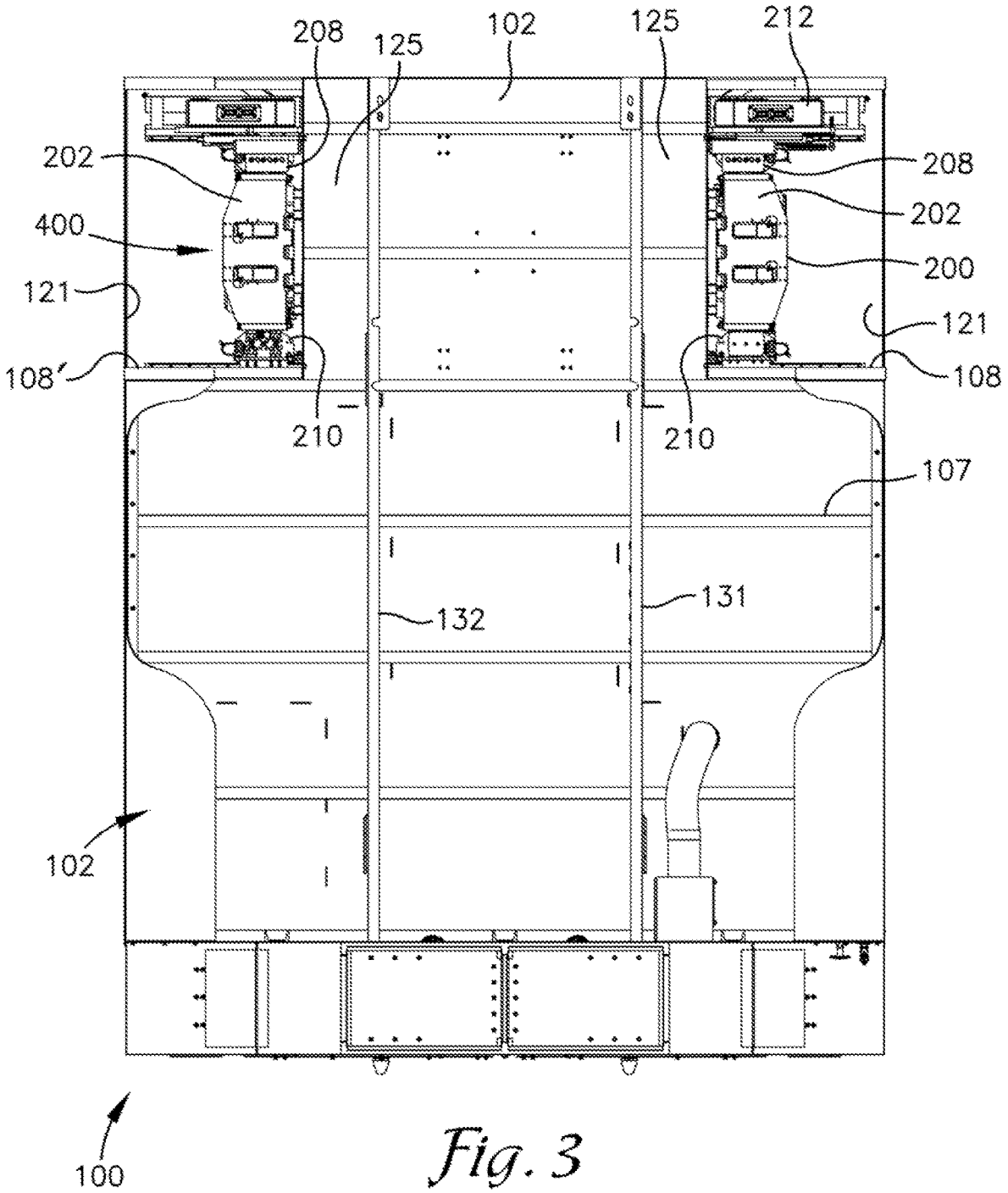
FIG. 3 is a bottom plan view of the equipment housing of the rail testing system with doors to compartments housing two separate ultrasonic rail testing apparatuses open.
Figure 33:
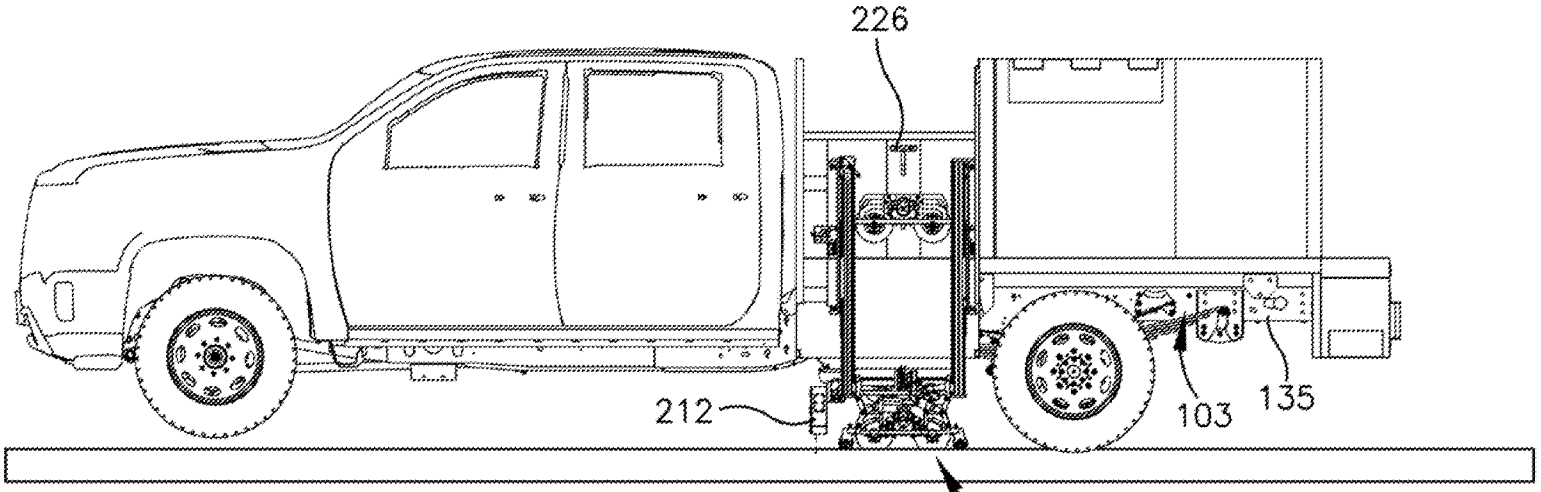
FIG. 33 is a side view of the rail testing apparatus on a hi-rail vehicle as in FIG. 2 in an operational configuration.

FIGS. 1-33 show one embodiment of a track testing system 100 for testing one or more components of a railroad track. The track testing system 100 includes an equipment housing 102 mounted on a frame 103 of a hi-rail vehicle, such as a hi-rail vehicle 104 (see for example FIGS. 2 and 33), for transporting along a section of the railroad track to be tested. The hi-rail vehicle 104 is a conventional highway vehicle having extendable and retractable flanged wheels (not shown) configured to travel over railroad rails 106*a* and 106*b*. FIG. 2 shows the track testing system 100, with portions removed, secured to a hi-rail vehicle 104 and the hi-rail vehicle 104 on rails 106*a* and 106*b* to be tested. FIG. 3 shows the track testing system 100 separated from the hi-rail vehicle 104 from below showing an under frame 107 for the track testing system 100 which is adapted to be mounted to the frame 103 of the hi-rail vehicle.

The equipment housing 102 has one or more compartments, such as compartments 108, 110, 112, 114, and 116. Each compartment 108, 110, 112, 114, and 116 may house railroad track testing gear (e.g., imagers and other testing devices, computing devices for controlling the testing devices, material usable for testing the railroad systems, et cetera). In the illustrated embodiment, compartment 108 houses an ultrasonic rail testing apparatus 200 (FIG. 2), compartment 110 houses a vision testing system (not shown) comprising cameras for inspecting railroad tracks, compartment 112 houses a LIDAR testing system (not shown) for evaluating railroad tracks, compartment 114 is configured for storage (e.g., stores tanks filled with water or washer fluid for conducting ultrasonic testing), and compartment 116 houses one or more controllers 117 for controlling the testing devices and sensors referenced herein. Compartment 108, housing the ultrasonic rail testing apparatus 200, has a rolling door 118 that may be opened to provide access to the compartment 108. An identical compartment 108' is formed in the equipment housing 102 on an opposite or right side thereof for housing a second ultrasonic rail testing apparatus 400. One or more of the other compartments may likewise include openable doors that allow for the respective compartment to be accessed. As used herein, directional references may be made with respect to an operator or driver sitting in the cab of the hi-rial vehicle 104 and facing in what would be considered the forward direction of travel of the hi-rail vehicle with the left side of the track testing system 100, including compartment 108, being located to the driver's left side and the right side of the track testing system 100 being located to the driver's right side. Rail testing or sensing apparatus 200 is therefore positioned on the left side of the system 100.

Figure 1:
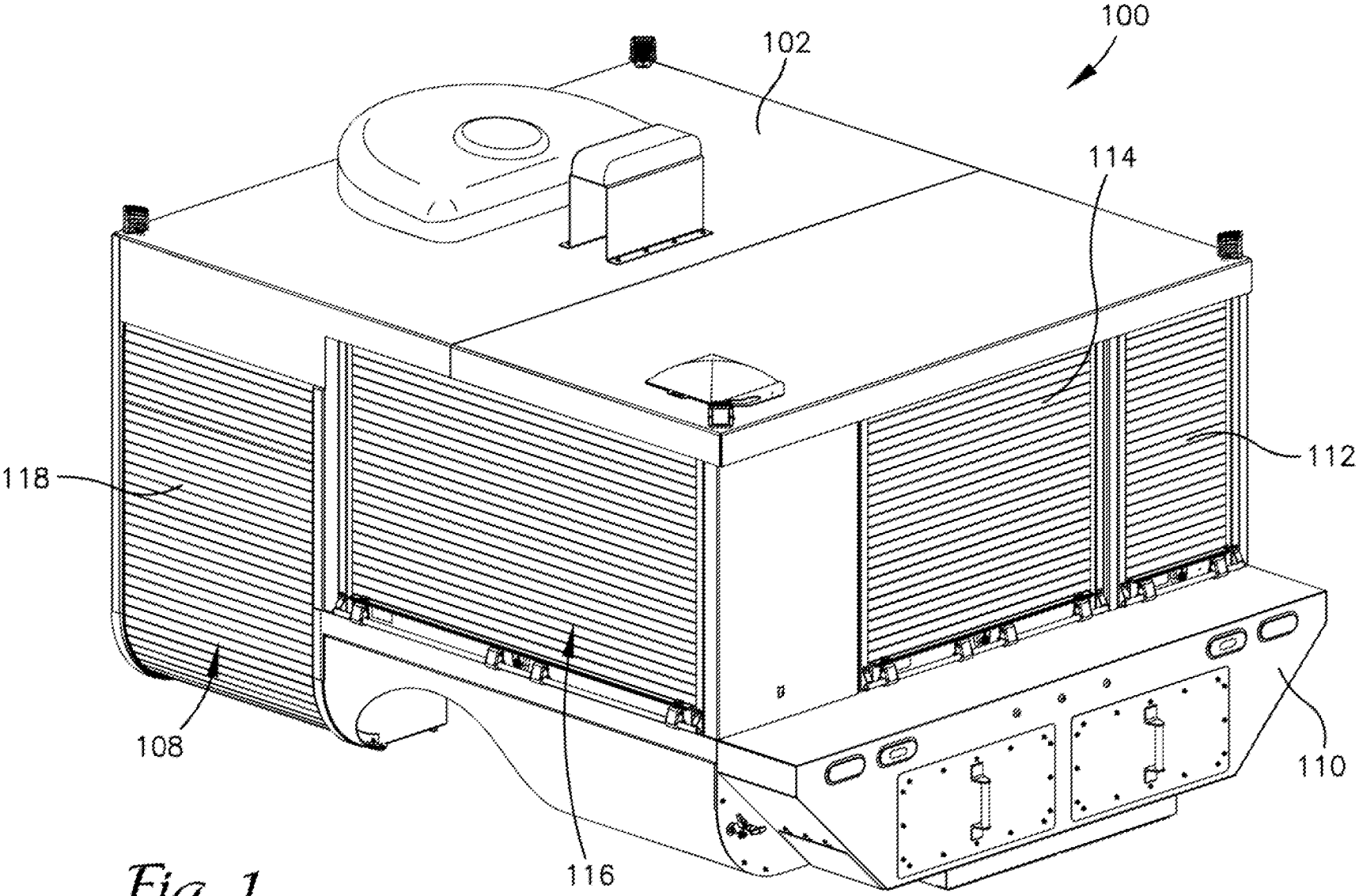
FIG. 1 is a perspective view of an embodiment of an equipment housing of a rail testing system.

With reference to FIG. 3, showing the bottom of the housing 102 mounted on under frame 107, access openings or deployment openings 121 are formed in a floor 125 of the portion of the housing 102 forming compartments 108 or 108' which are covered by the rolling door 118 in the closed position as generally shown in FIG. 1. The rail testing apparatus 200 and 400 may be deployed downward through the deployment openings 121 when the rolling doors 118 are opened. The longitudinal beams 131 and 132 of the under frame 107 of track testing system 100 are generally mounted in close proximity to the main, longitudinally extending beams 135 (see FIGS. 23 and 33) of the frame 103 of the hi-rail vehicle 104 to which it is attached, with the deployment openings 121 extending outward from the main beams 135 such that the rail testing apparatuses 200 and 400 may be deployed downward through the deployment openings 121 on either side of the main beams 135.

Figure 4:
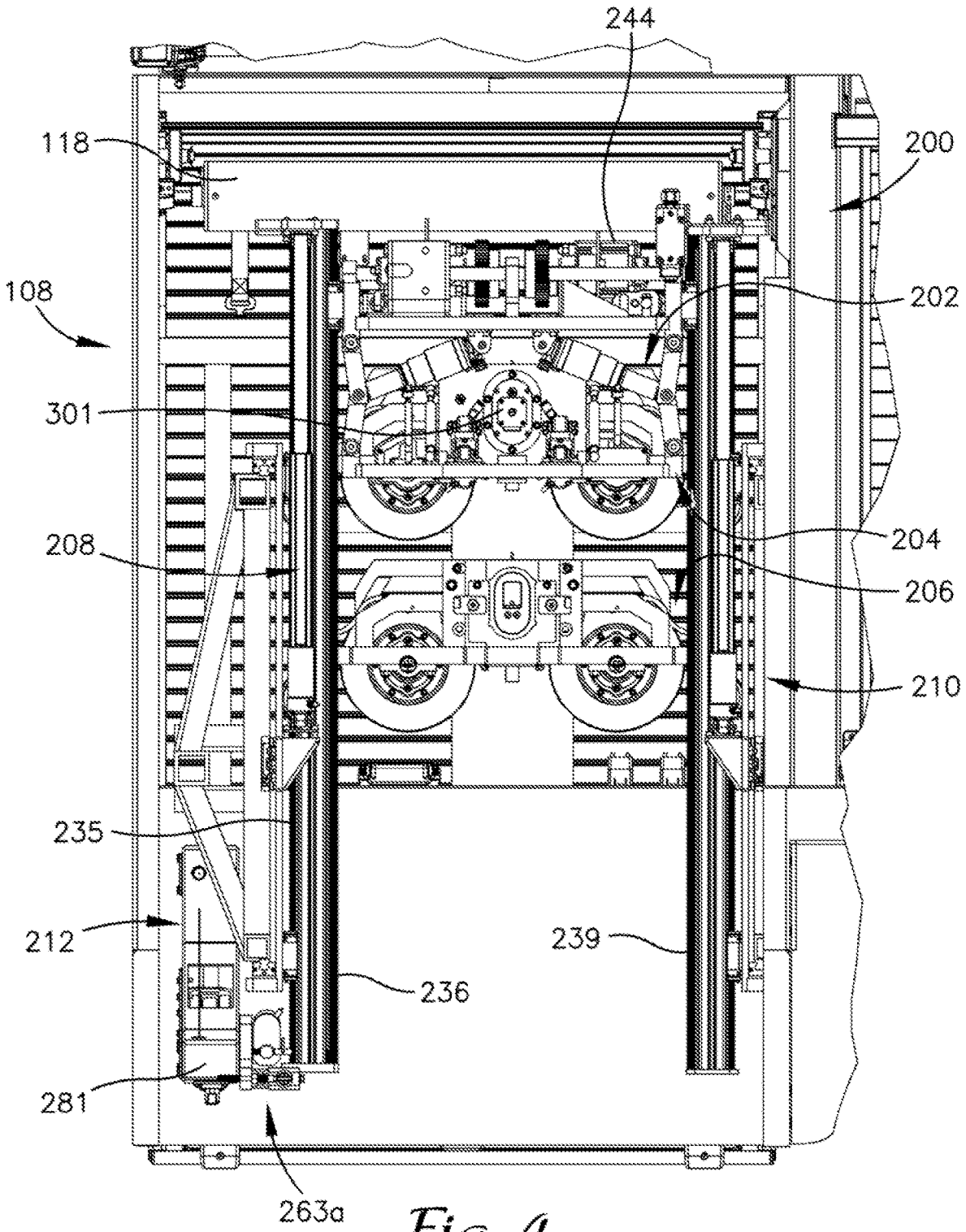
FIG. 4 is an enlarged side elevational view of an embodiment of an ultrasonic rail testing apparatus in one compartment of the equipment housing with the door open.
Figure 5:
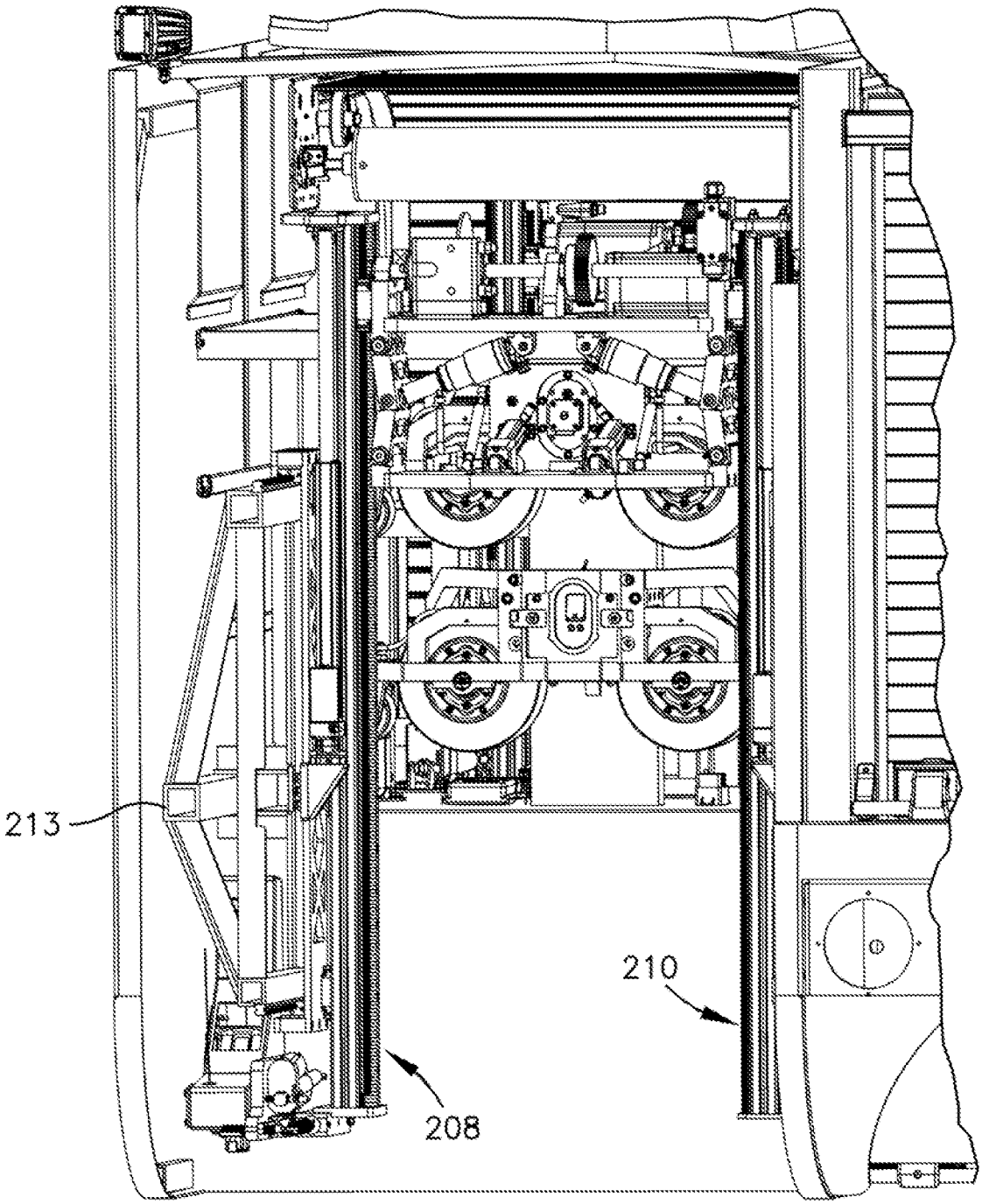
FIG. 5 is a side perspective view of the ultrasonic rail testing apparatus of FIG. 4.
Figure 6:
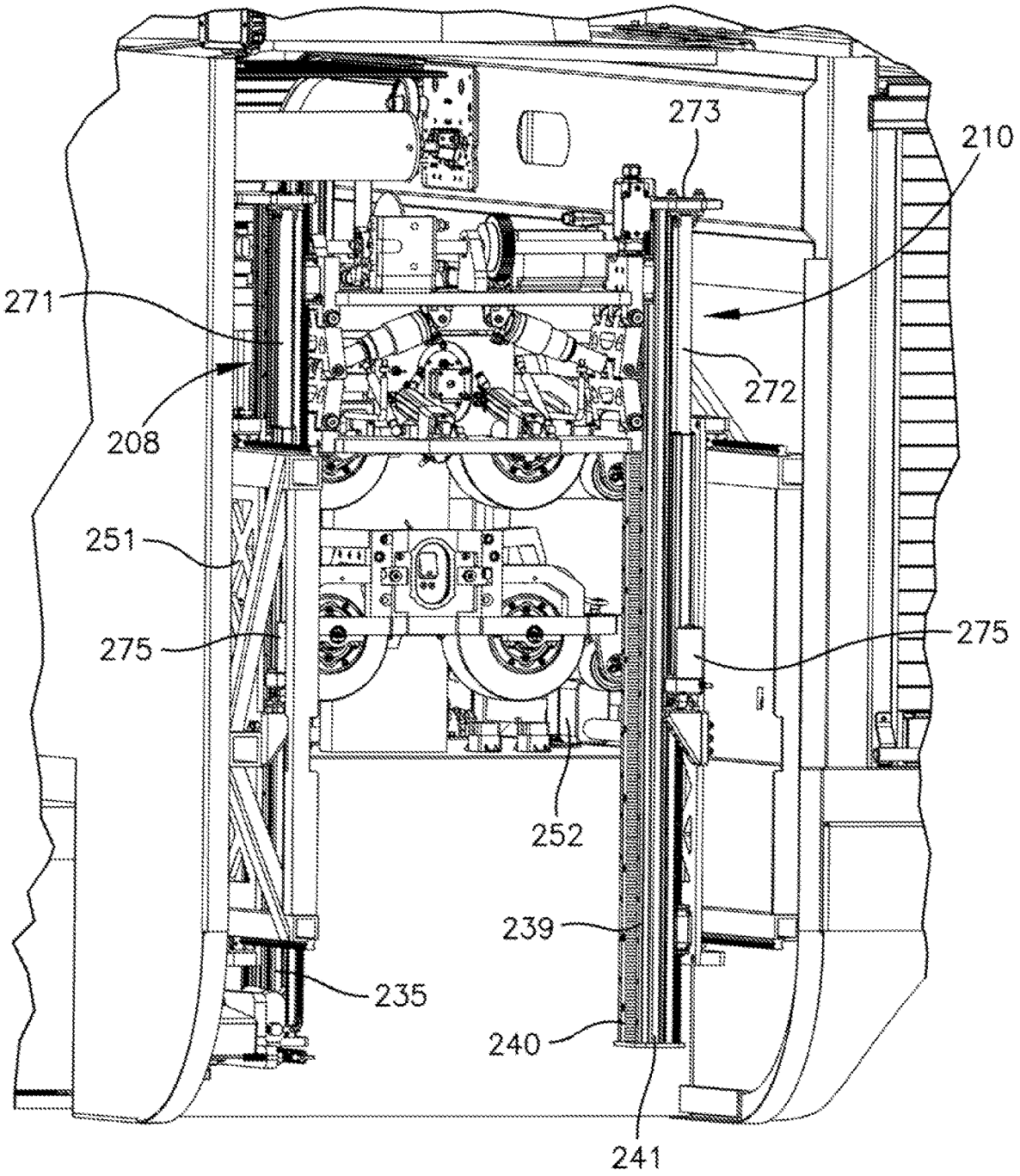
FIG. 6 is another side perspective view of the ultrasonic rail testing apparatus of FIG. 4.

FIGS. 4-6 shows the compartment 108 with the rolling door 118 fully retracted or opened to illustrate an embodiment of the rail property sensing apparatus 200 which in the embodiment shown is an ultrasonic rail testing apparatus 200 and which may also be referred to as an ultrasonic rail imaging system 200. The illustrated apparatus 200 comprises a carriage 202, a primary RSU or sensor pod 204, a secondary RSU or sensor pod 206, a proximal, position adjustable vertical track 208, a distal, position adjustable vertical track 210, and a rail centering sensor system 212 for housing time of flight (TOF) sensors. The sensor system 212 may also ber referred to as a sensor alignment sensor system as the system is used to collect data which can be processed to determine the shape of the rail which is then used by the controller 117 to control the position relative to the rail of the RSUs or other types of rail property sensors. Each of these components are described in more detail herein. The proximal, position adjustable vertical track 208 is closer to or proximate the cab of the hi-rail vehicle 104 relative to the distal, position adjustable vertical track 210. The proximal, position adjustable vertical track 208 may alternatively be referred to as the proximal, front or leading vertical track and the distal, position adjustable vertical track 210 may alternatively be referred to as the distal, rear or trailing vertical track 210.

Figure 7:
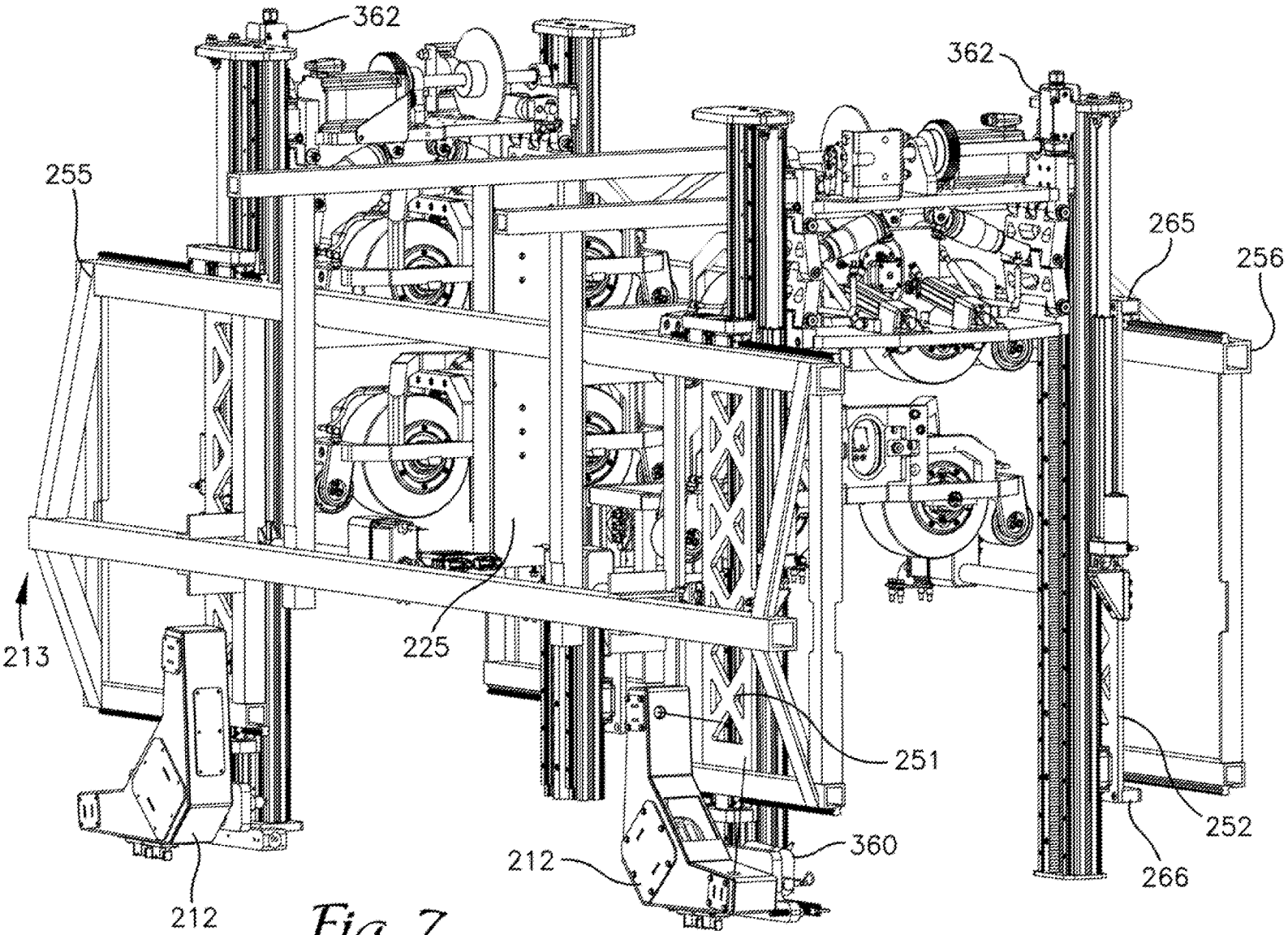
FIG. 7 is a perspective view of the two sets of the ultrasonic rail testing apparatus and a support structure thereof with the equipment housing removed.
Figure 8:
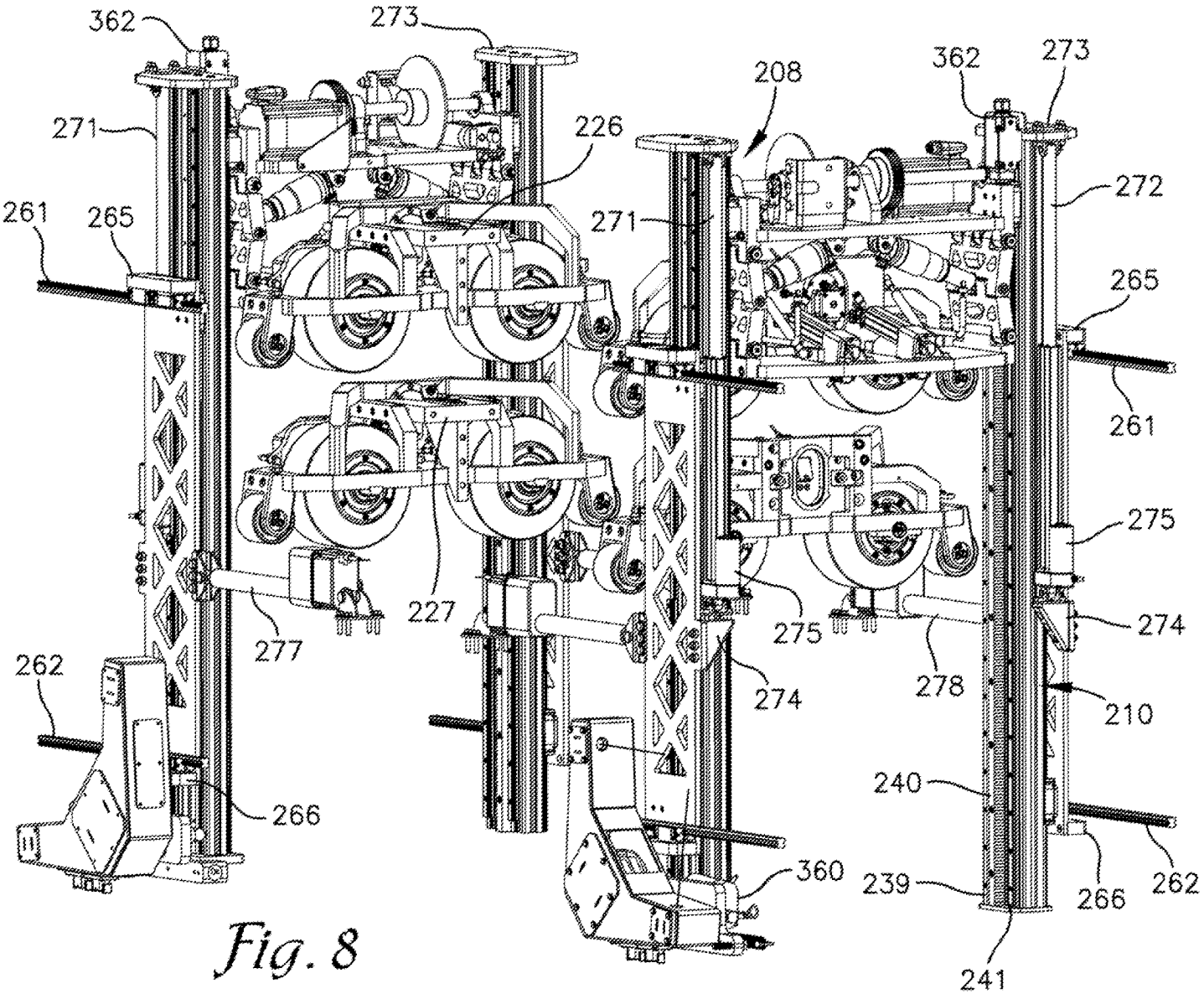
FIG. 8 is a view similar to FIG. 7 with the support structure removed.

FIG. 3 shows the housing 102 from below with the rolling doors 118 for the compartments 108 and 108' open and with the carriages 202 positioned in a stored position and the primary and secondary sensor pods 204 and 206 positioned above the floor 125 of the housing 102 and therefore not viewable in FIG. 3. FIG. 7 shows the rail testing apparatuses 200 and 400 mounted on a testing apparatus support frame 213 with the equipment housing 102 removed to show detail. FIG. 8 shows the rail testing apparatuses 200 and 400 with the support frame 213 removed.

FIGS. 3-8 (as well as FIGS. 21-23) show the rail testing apparatus 200 in an initial or stowed configuration for storage (e.g., while the apparatus 200 is being stored overnight, stored between jobs, or transported to a section of track to be inspected, et cetera). FIGS. 30-33 show the ultrasonic rail testing apparatus 200 in a final or testing configuration. In the final or testing configuration, the testing apparatus 200, and specifically the RSUs thereof, are usable for testing rails. FIGS. 22-33 discussed further below show the various steps taken to position the ultrasonic rail testing apparatus 200 from the stowed configuration to the testing configuration. As will become clear, the ultrasonic rail testing apparatus 200 is configured for the ultrasonic testing of a solitary rail (e.g., rail 106*a* in FIG. 2) and independently operable ultrasonic rail testing apparatus 400 in compartment 108' is configured for testing the other rail (e.g., rail 106*b* in FIG. 2). Testing each rail 106*a* and 106*b* using an independent ultrasonic rail testing apparatus ensures that RSUs associated with each apparatus remain centered on their respective rail notwithstanding inconsistencies (e.g., disparity in wear) between the two rails 106*a* and 106*b*. The rail testing apparatus 200 and 400 are deployable from their respective compartments 108 and 108' in the housing 102 on opposite sides of the main beams 135 of the truck frame 103.

To illustrate the workings of the ultrasonic rail testing apparatus 200, reference will be made to the X-axis, Y-axis, and Z-axis (see FIG. 2). The X-axis extends from the gauge side to the field side of a rail, such as rail 106*a* or 106*b*. As is known, the gauge side is the side of the rail along which rail car wheel flanges run. That is, the X-axis laterally extends from the center of the housing 102 to the outside. The Z-axis, as defined herein, is the vertical axis, i.e., extends vertically from a rail, such as rail 106*a* towards the sky and the Y-axis extends longitudinally along a center of the rail, such as rail 106*a*.

Figure 9:
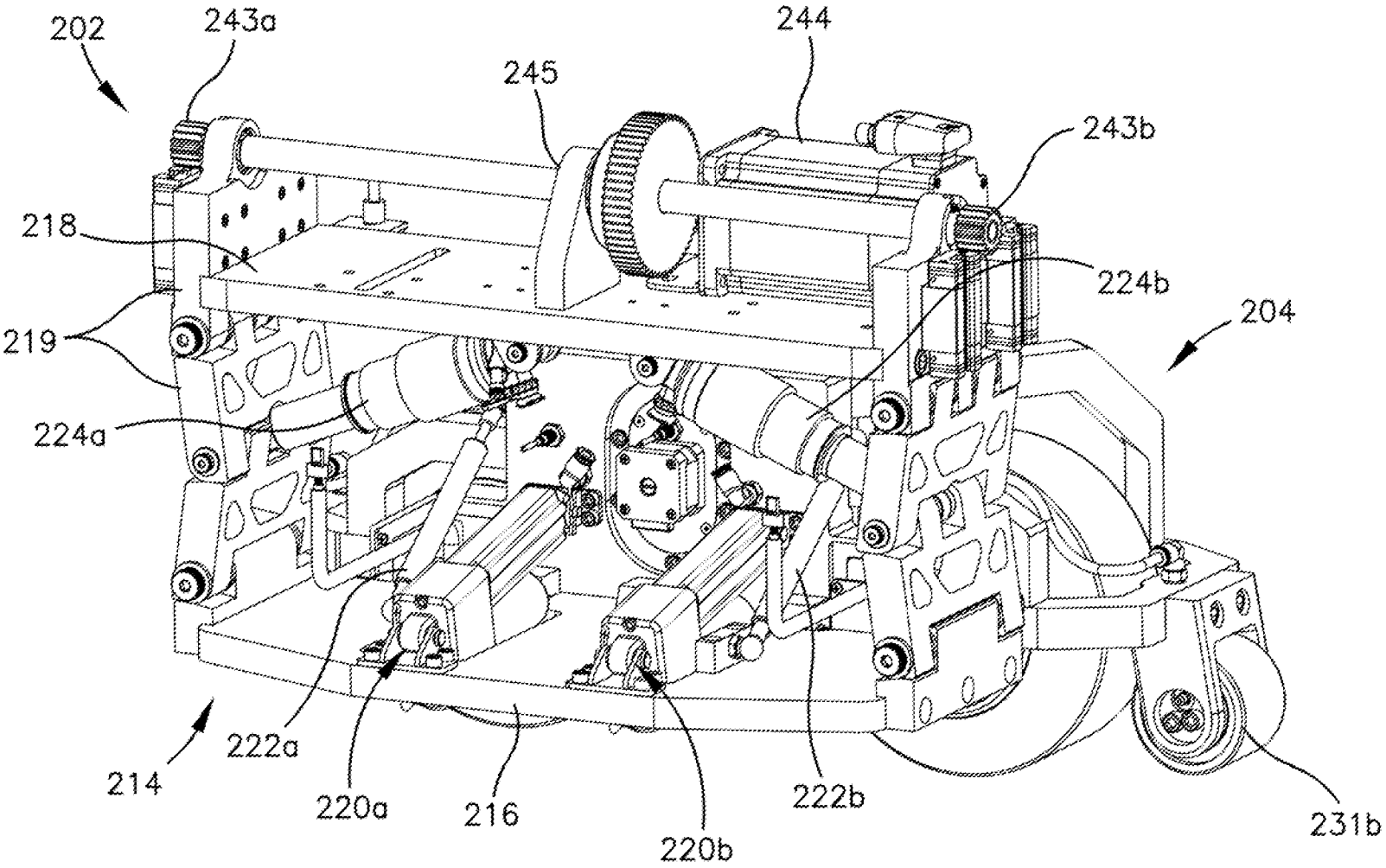
FIG. 9 is a perspective view of a carriage of the rail testing apparatus of FIG. 4.

FIG. 9 shows the carriage 202 in more detail. As discussed herein, the carriage 202 is configured to selectively mate with one of the primary RSU pod 204 and the secondary RSU pod 206. In FIG. 9, the carriage 202 is shown coupled to and in front of the primary sensor pod 204. The carriage 202 comprises a carriage frame 214 having a lower shelf 216 and an upper shelf 218 connected together by suspension links or suspension members 219 pivotably connected together and to the lower shelf 216 and upper shelf 218. In the illustrated embodiment, the carriage 202 includes cant (or camber) actuators 220*a* and 220*b*, actuator-associated gas shocks 222*a* and 222*b*, and vertical suspension gas shocks 224*a* and 224*b*. The cant actuators 220*a* and 220*b* and the actuator associated gas shocks 222*a* and 222*b* are supportably coupled to the lower shelf 216.

Figure 10:
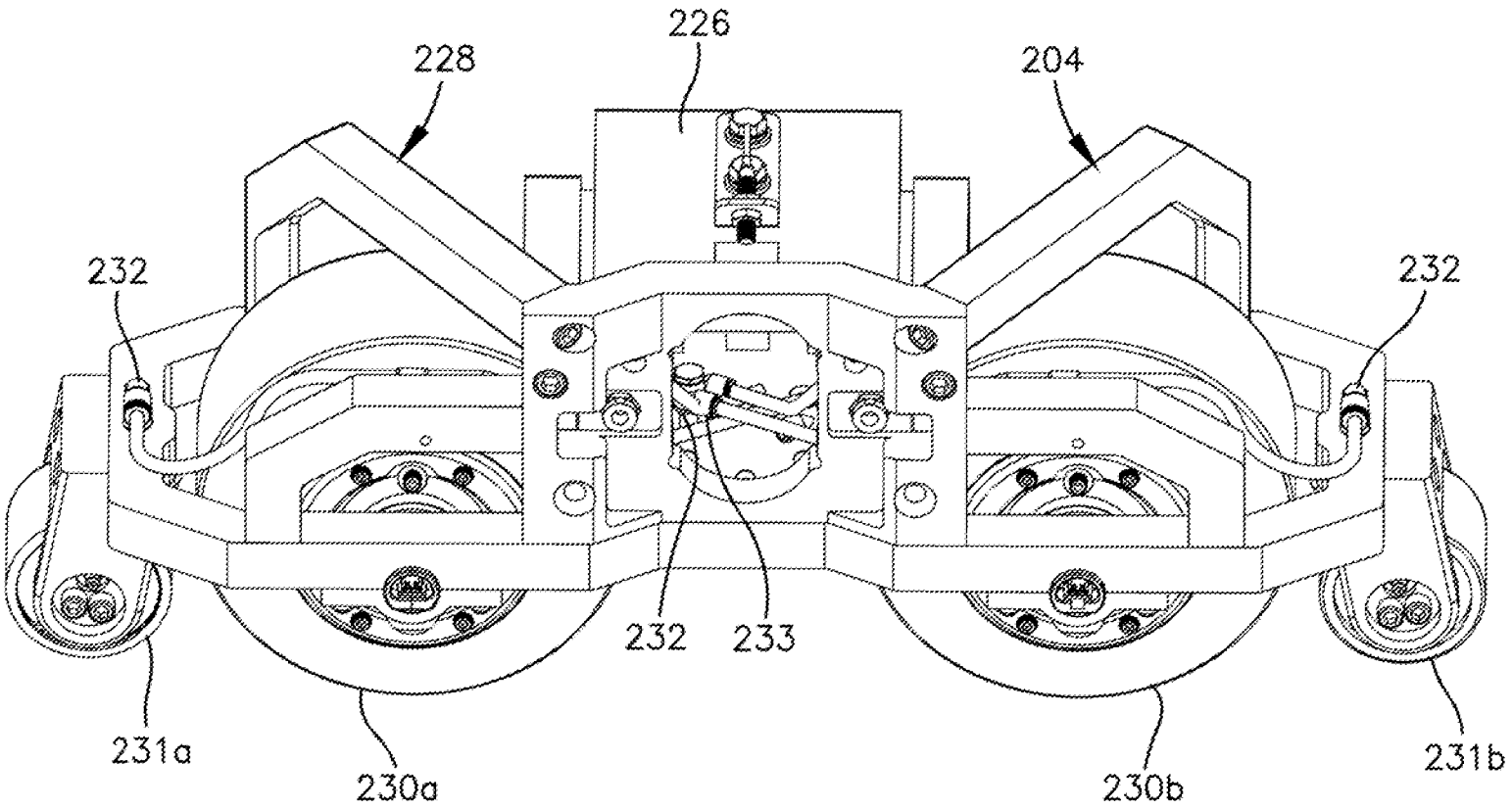
FIG. 10 is a perspective view of a primary sensor pod of the rail testing apparatus of FIG. 4.
Figure 20:
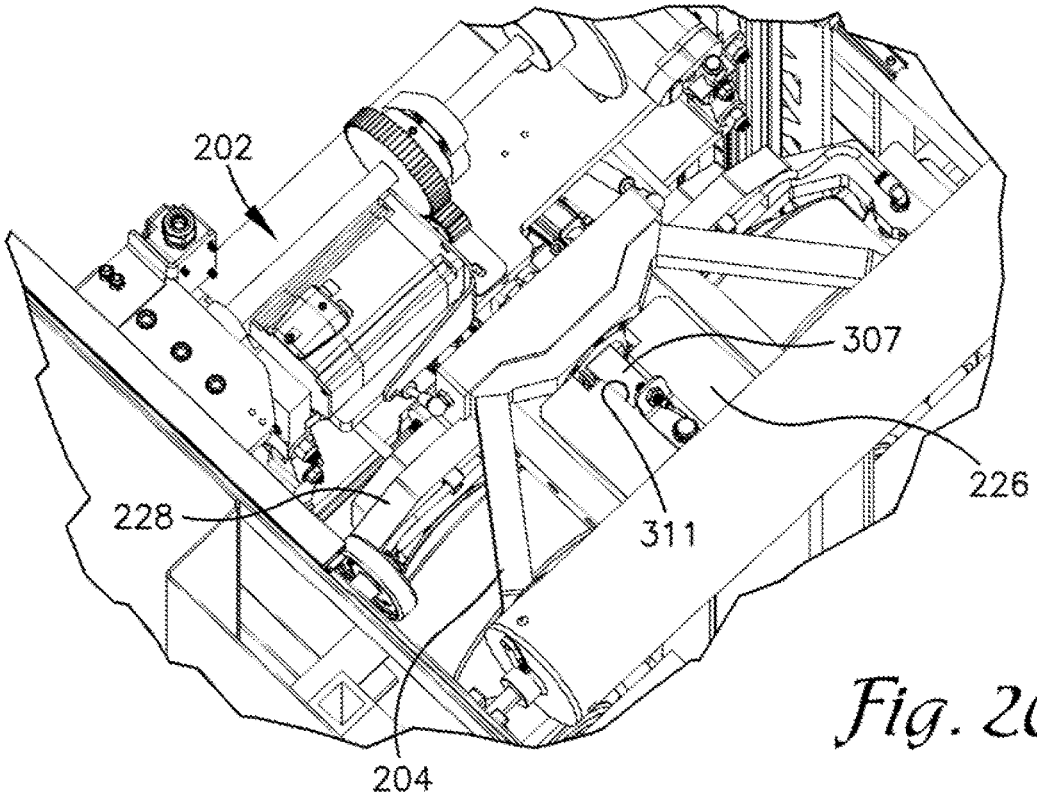
FIG. 20 is a fragmentary perspective view showing the pod latched to the holster. is a perspective view showing the dual-purpose locking mechanism in an operating position.

FIG. 20 shows the primary sensor pod 204 in a stored position connected to or holstered in a primary pod storage holster 226 or pod docking station 226 connected to a holster support column 225 in each compartment 108 and 108'. The holster support column 225 may also be referred to as a frame member beam or post and may be connected to the under frame 107 and project up through the floor 125 of the housing 102. The holster support column 225 may also be referred to as a docking station support column or beam and may be connected to other parts of the housing 102 or frame members within the housing. As generally shown in FIG. 7, a secondary pod storage holster 227 is mounted on the each support column 225 below the primary pod storage holster 226 in each compartment 108 and 108' for storing the secondary sensor pod 206 below the primary storage pod 204. Each of the sensor pods 204 and 206 has a pod frame 228 and two RSUs 230*a* and 230*b* rotatably coupled to the pod frame 228 in line with each other. Further, a compression control roller is rotatably coupled to each of the two ends of the frame 228 (rollers 231*a* and 231*b* as shown in FIG. 10). The compression control rollers 231*a* and 232*b* are generally incompressible and are mounted on the pod frame 228 at a set height relative to the frame 228 selected to limit the extent each fluid filled, rubber RSU may be compressed against the rail 106*a* or 106*a*.

As discussed previously, in one embodiment each roller search unit or RSU 230*a* and 230*b* comprises an ultrasonic sensor system including a fluid-filled wheel and ultrasonic transducers. The fluid-filled wheel is typically formed of a pliant material that deforms to establish a contact surface when the wheel is pressed against the rail, and the ultrasonic transducers are configured and positioned for transmitting ultrasonic beams through the fluid in the wheel and through the contact surface into the rail and for receiving the reflected beams from the rail. One such RSU is described in U.S. Pat. No. 8,424,387, the disclosure of which is incorporated by reference herein in its entirety. The roller search units may also be referred to as imaging sensors or rail imaging sensors as the output from the sensors may be processed to provide a visual output indicative of a defect on the rail 106*a* or 106*b* or otherwise create a visual representation of the shape or other properties, characteristics or flows in the rail including cracks or the like. The RSUs may also be referred to as rail property sensors with the information or data collected by the sensors being indicative of a property of the rail such as shape or flows or density. It is foreseen that other types of sensors could be used for sensing one or more other properties of a rail in addition to the properties sensed by the RSUs including Eddy current sensors, inductive sensors, Lidar imaging sensors or systems, line vision systems, cameras or the like.

The two RSUs 230*a* and 230*b* are configured to roll over one of the two rails (e.g., rail 106*a*) for ultrasonic testing. The wheels 231*a* and 231*b* hit or engage the head of the rail 106*a* and rotate with the RSUs 230*a* and 230*b* and support the carriage 202 during testing. The primary sensor pod 204 has nozzles 232 (FIG. 10), connected to a fluid supply system 233 for spraying a liquid onto the rails 106*a* and 106*b* to facilitate the ultrasonic testing. One nozzle 232 is preferably positioned to spray liquid in front of and behind each RSU 230*a* and 230*b*.

Figure 11:
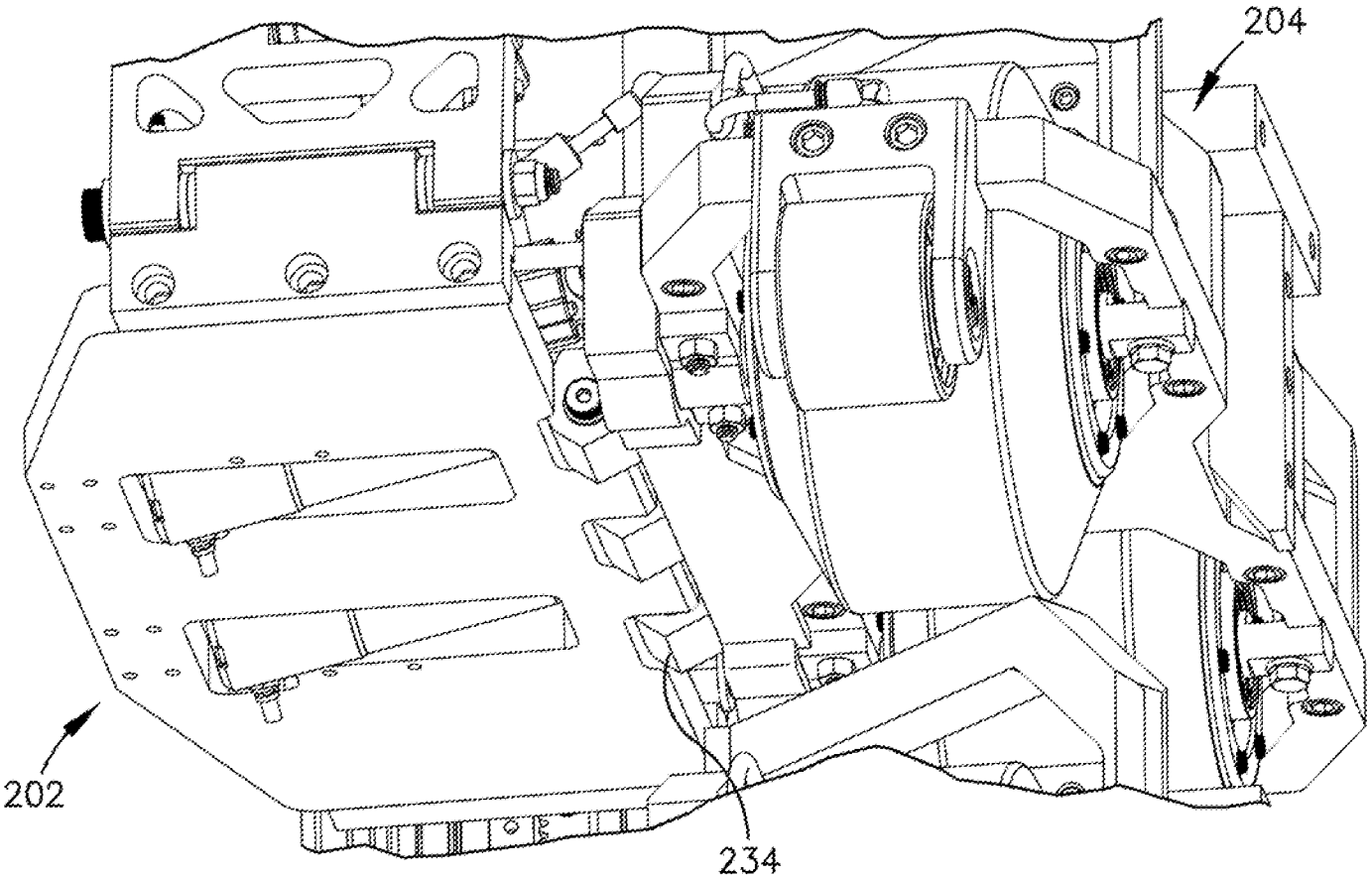
FIG. 11 is a fragmentary perspective view showing a hinged coupling between the carriage of FIG. 9 and the primary sensor pod of FIG. 7.

The secondary sensor pod 206 is generally identical to the primary sensor pod 204. The secondary sensor pod 206 may be used for rail testing in place of the primary sensor pod 204, e.g., when the primary sensor pod 204 is being serviced or needs servicing. In embodiments, the sensor pod used for testing may be periodically cycled into and out of use to ensure that the primary sensor pod 204 and the secondary sensor pod 206 encounter comparable wear. As is known, rails are typically mounted on railroad ties so that the vertical axis of each rail (e.g., rails 106*a* and 106*b*) is tilted slightly to the gauge side to facilitate railcar operation, and that this deviation from the vertical is referred to as the cant (or camber) of the rails. Thus, the RSU sensor pod 204 may also need to be tilted to ensure a preferred alignment of the RSUs 230*a* and 230*b* with the rail 106*a*. As noted, the carriage 202 is coupled to the sensor pod (e.g., the primary sensor pod 204) during rail testing operation. The cant actuators 220*a* and 220*b* (FIG. 9) of the carriage 202 may be actuated to cause the primary sensor pod 204 to tilt such that the RSUs 230*a* and 230*b* are aligned with the rail 106*a*. FIG. 11 (like FIG. 9) shows the carriage 202 coupled to the primary sensor pod 204 with the primary sensor pod 204 shown to the right of the carriage 202. As shown in FIG. 11, the carriage 202 is rotatably coupled to the primary sensor pod 204 via a hinge 234. Actuation of the cant actuators 220*a* and/or 220*b* (see FIG. 9) causes the primary sensor pod 204 coupled to the carriage 202 to tilt about a horizontal axis through the hinge 234 and to ensure appropriate alignment between the RSUs 230*a* and 230*b* and the rail 106*a*.

The cant actuators 220*a* and 220*b* may be independently adjustable. The actuator-associated gas shocks 222*a* and 222*b* serve to smooth out any shock that may undesirably result from the actuation of the cant actuators 220*a* and 220*b* or shocks transmitted through the sensor pod 204 to the carriage 202 resulting, for example, from the RSUs 230*a* and 230*b* engaging a bump or gap in the rail 106*a*. The vertical suspension gas shocks 224*a* and 224*b*, connected to suspension members 219, may similarly smooth out any shocks that cause the carriage 202 and the RSU pod 204 coupled thereto to undesirably jolt in the vertical direction.

The carriage 202 is movably coupled to the proximal vertical track 208 and the distal vertical track 210. As discussed herein, the carriage 202 can travel up and down in the vertical direction (the Z-axis) along the vertical tracks 208 and 210. Further, and as discussed in more detail hereafter, each of the proximal vertical track 208 and the distal vertical 210 can itself travel or be advanced in a lateral and horizontal direction (the X-axis) and the vertical direction (the Z-axis), thereby causing the carriage 202 coupled thereto to also travel in these directions.

Figure 21:
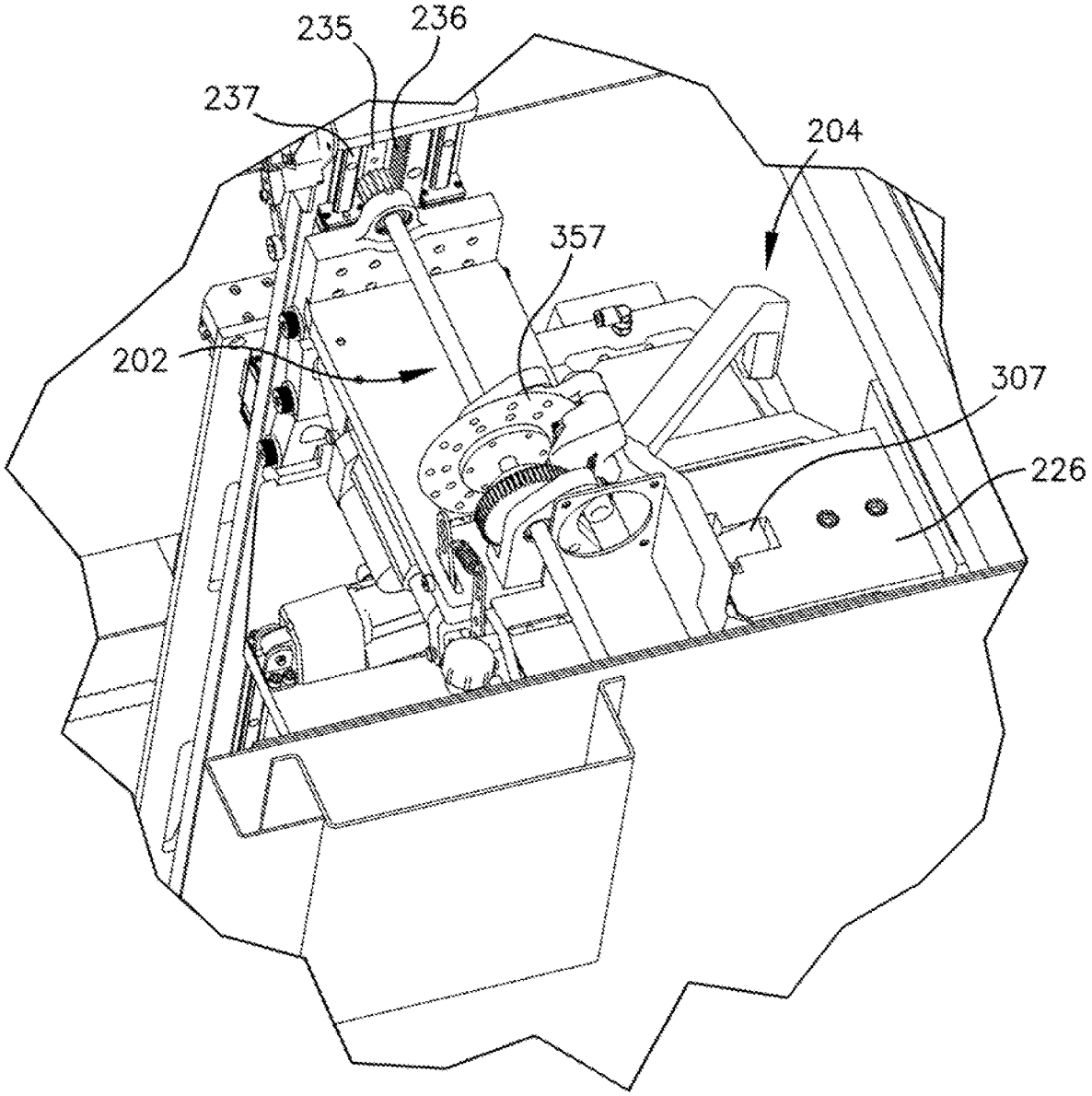
FIG. 21 is another fragmentary perspective view of the pod latched to the holster with the carriage adjacent the pod.

As best seen in FIGS. 4-9 and 21, the proximal vertical track 208 comprises an inner gear track 235 formed by a rack gear 236 spaced apart from and facing a guide strip 237 to form a pinion receiving channel therebetween (see FIG. 21). The distal vertical track 210 likewise comprises an inner gear track 239 formed by a rack gear 240 spaced apart from and facing a guide strip 241 to form a pinion receiving channel therebetween. The inner gear track 235 of the proximal vertical track 208 and the inner gear track 239 of the distal vertical track 210 face each other (i.e., the pinion receiving channel of each of the inner gear tracks 235 and 239 opens toward the carriage 202).

The carriage 202 is movably coupled to the inner gear track 235 of the proximal vertical track 208 and the inner gear track 239 of the distal vertical track 210 for vertical movement relative thereto. For example, the carriage 202 is movably coupled to the inner gear tracks 235 and 239 via pinions 243*a* and 243*b* (FIG. 9) or another suitable linkage. The carriage 202 has a carriage Z-axis motor 244 (see FIG. 9) that can cause the carriage 202 to move up and down the inner gear tracks 235 and 239 in the vertical direction using or driving the pinions or cogwheels 243*a* and 243*b* having gear teeth which matingly mesh with gear teeth on the racks 236 and 240 of the respective inner gear tracks 235 and 239. The Z-axis motor 244 may be located on the upper shelf 218 of the carriage frame 214 (FIG. 9) and is operable to drive the pinions 243*a* and 243*b*, via transmission 245 in either direction to advance the carriage 202 upwards and downwards relative to the proximal and distal, vertical tracks 208 and 210. It is foreseen that other means for movement of the carriage 202 along the vertical tracks 208 and 210 could be utilized including hydraulic, pneumatic or electrically operated actuators such as piston type actuators. Such actuators may also be referred to as Z-axis motors imparting vertical movement on the carriage 202 relative to the vertical tracks 208 and 210. It is also foreseen that the vertical tracks 208 and 210 could take other forms including telescoping or sliding members or a threaded rod with the carriage mounted on a threaded follower.

Figure 18:
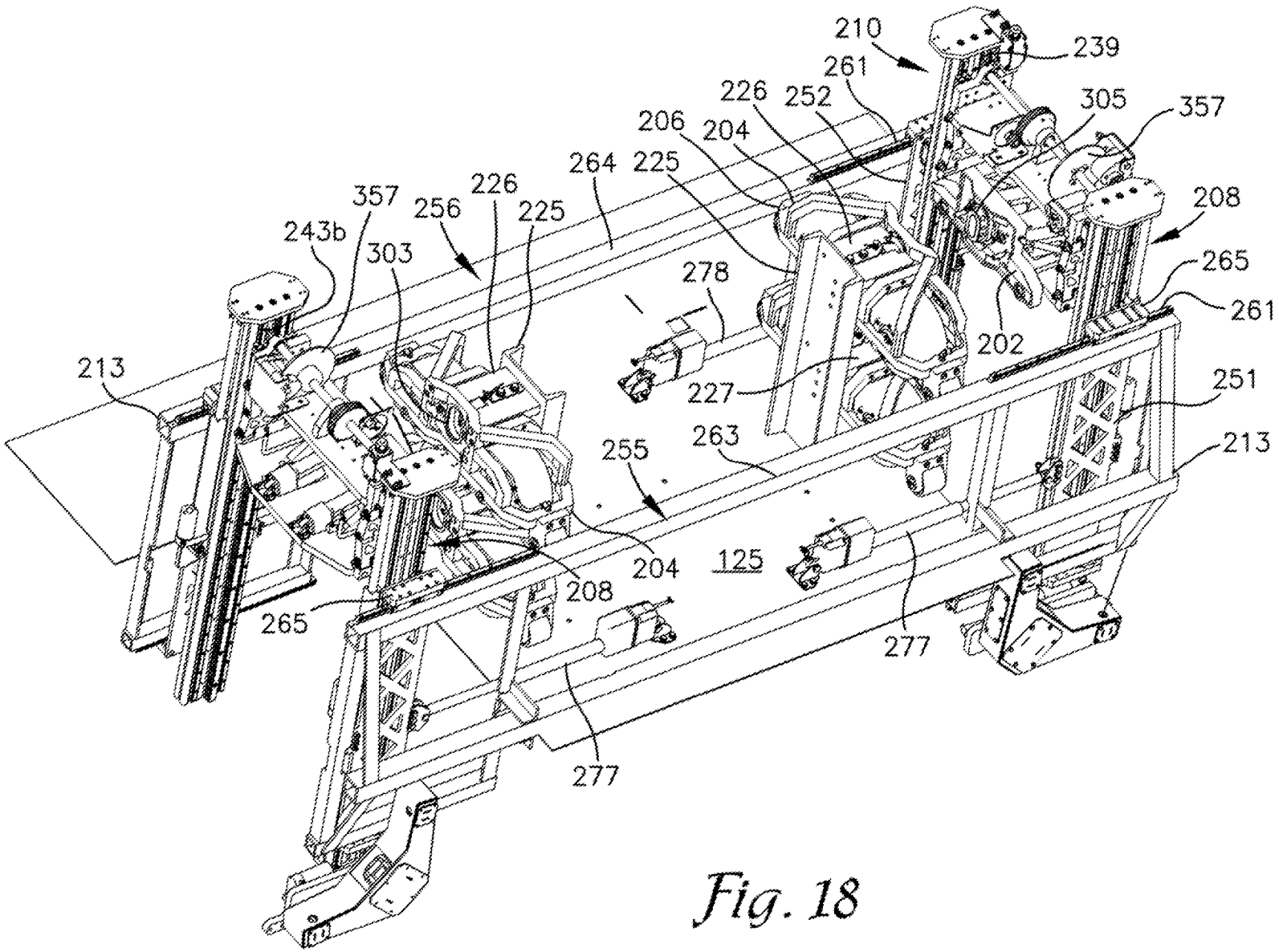
FIG. 18 is a perspective view of the two sets of the ultrasonic rail testing apparatus and a support structure thereof with the equipment housing removed and showing the carriage of each rail testing apparatus shown separated from a respective one of the pods mounted in a holster for the respective pod.

As noted, each of the proximal vertical track 208 and the distal vertical track 210 are advanceable in the vertical direction (along the Z-axis) and in a horizontal or lateral direction (along the X-axis) relative to the equipment housing 102 and the compartment 108. More specifically, and as best seen in FIGS. 7, 8 and 18, the proximal vertical track 208 is movably or slidably mounted for vertical movement on a proximal, vertical track carrier 251 and the distal vertical track 210 is movably or slidably mounted for vertical movement on a distal, vertical track carrier 252. Track carriers 251 and 252 may also be referred to as carrier frames or front and rear, vertical track carriers or front and rear vertical track carrier frames. The proximal and distal, vertical track carriers 251 and 252 are movably or slidably mounted for lateral movement along the X-axis on proximal and distal track support frames 255 and 256 which may also be referred to as front and rear track support frames or front and rear track assembly base frames. The proximal and distal track support frames 255 and 256 may be interconnected forming a single, testing apparatus frame 213.

The proximal and distal track support frames 255 and 256 are connected to the equipment housing 102 or a under frame 107 supporting the equipment housing 102 and positioned adjacent front and rear walls of the equipment housing 102 surrounding compartment 108. The track support frames 255 and 256, the equipment housing 102 and the holster support columns 225 may be individually or collectively be considered part of a support structure for supporting the ultrasonic rail testing apparatus 200 and 400 and components thereof relative to the hi-rail vehicle 104 or other vehicles or the like for moving the rail testing apparatus 200 and 400 along the rails 106*a* and 106*b*. Upper and lower horizontal tracks 261 and 262 may be mounted on top of and to the underside of upper and lower track support members 263 and 264 respectively of the proximal and distal track support frames 255 and 256. The proximal and distal, vertical track carriers 251 and 252 include outwardly projecting glides 265 and 266 which extend above and below the upper and lower horizontal tracks 261 and 262 respectively in sliding engagement therewith.

A vertically oriented, proximal linear actuator 271 is connected between the proximal, vertical track carrier 251 and proximal, vertical track 208 and a vertically oriented, distal linear actuator 272 is connected between the distal vertical track carrier 252 and the distal vertical track 210. The linear actuators 271 and 272 are oriented to impart vertical linear motion on the proximal and distal vertical tracks 208 and 210 respectively relative to the proximal and distal vertical track carriers 251 and 252 to raise and lower the proximal and distal vertical tracks 208 and 210 relative to the proximal and distal vertical track carriers 251 and 252. In the embodiment shown, the distal end of a piston of each actuator 271 and 272 is connected to a mounting plate 273 on the upper end of the respective vertical track 208 and 210 and the lower end of a cylinder of each actuator 271 and 272 is supported on a support member 274 connected to a respective track carrier 251 and 252. In the embodiment shown, the actuators 271 and 272 are electrically actuated and powered by electric motors 275 coupled thereto. It is foreseen that the actuators could be powered by other known means including hydraulically, pneumatically or mechanically. The vertically oriented, proximal and distal linear actuators 271 and 272 may also be referred to as Z-axis motors 271 and 272 operable to raise and lower the proximal and distal vertical tracks 208 and 210 respectively. It is foreseen that a single Z-axis motor connected to the vertical tracks 208 and 210 by a transmission could be used to drive both vertical tracks 208 and 210.

A horizontally oriented, proximal linear actuator 277 is connected between a floor of the housing 102 in the compartment 108 and the proximal, vertical track carrier 251. A horizontally oriented, distal linear actuator 278 is connected between a floor of the housing 102 in the compartment 108 and the proximal, vertical track carrier 251. The proximal and distal linear actuators 277 and 278 may also be connected between the testing apparatus 213 and the respective proximal and distal, vertical track carrier 251 and 252. The proximal and distal linear actuators 277 and 278 are operable to cause the proximal and distal, vertical track carriers 251 and 256 to move back and forth in the lateral and horizontal direction (i.e., along the X-axis) and inward and outward relative to the compartment 108. Lateral movement of the proximal and distal, vertical track carriers 251 and 252 back and forth along the X-axis causes the proximal and distal, vertical tracks 208 and 210 and the carriage 202 mounted thereon to also move laterally, in and out of the compartment 108. The horizontally oriented, proximal and distal linear actuators 277 and 278 may also be referred to as X-axis motors 277 and 278 operable to extend and retract the proximal and distal vertical track carriers 251 and 252 and attached vertical tracks 208 and 210 respectively. It is foreseen that a single X-axis motor connected to the vertical track carriers 251 and 252 by a transmission could be used to drive both vertical track carriers 251 and 252.

It is foreseen that movement of the carriage 202 horizontally or along X-axis relative to the support structure could be imparted by moving the carriage 202 horizontally or along the X-axis relative to the vertical tracks 208 and 210 instead of moving the vertical tracks 208 and 210 horizontally or along the X-axis relative to the support structure. For example, the carriage could be mounted on horizontally extending tracks or guides connected to the vertical tracks 208 and 210. It is also foreseen that structure such as the pods 204 and 206 or pod frames 204 and 206 may be referred to as carriages or carriers for the RSUs or other rail imaging sensors and that the RSUs or rail imaging sensors could be moved horizontally or along the X-axis relative to the support structure by moving the pods or pod frames relative to a carriage for the pods which is in turn connected to the vertical tracks.

The carriage 202, vertical tracks 208 and 210, the vertical track carriers 251 and 252 and the support frames 255 and 256 and the actuators or motors associated therewith generally comprise a sensor positioning assembly for adjusting the position of the RSUs or other types of rail property sensors relative to an associated rail 106*a* or 106*b*. In the embodiment shown separate sensor positioning assemblies are mounted in the separate compartments 108 and 108' on opposite sides of the hi-rail vehicle main beams 135 and are independently operable to independently deploy and position separate carriages with separate sets of RSUs or RSU pods connected thereto to allow independent control and positioning of each set of RSUs relative to each rail 106*a* and 106*b*. The vertical tracks 208 and 210, the vertical track carriers 251 and 252 and the support frames 255 and 256 and the actuators and motors associated therewith may also be described as a carriage positioning assembly.

The proximal and distal vertical tracks 208 and 210 are stored in each of the compartments 108 and 108', in a stored alignment, after having been advanced to a fully raised alignment, by fully extending the vertically oriented, proximal and distal linear actuators 271 and 272 and then retracting the horizontally oriented, proximal and distal linear actuators 277 and 278 to draw the proximal and distal vertical track carriers 251 and 252 and the attached proximal and distal vertical tracks 208 and 210 back into the compartments 108 and 108'.

To deploy the RSUs 230*a* and 230*b* on pod 204 or 206 connected to carriage 202 through the deployment openings 121 through the floor 125 the vertical track carriers 251 and 252 and the vertical tracks 208 and 210 connected thereto are extended laterally out of the compartment 108 or 108' by extension of the horizontally oriented, proximal and distal linear actuators 277 and 278. The proximal and distal vertical tracks 208 and 210 may then be lowered by retracting the vertically oriented, proximal and distal linear actuators 271 and 272. In an embodiment, the actuators 271 and 272 advance between full extension and full retraction without the ability to incrementally control the extent of extension or retraction which makes it easier to determine and control the vertical position of the carriage 202 relative to the compartment 108 or 108' and the rail 106*a* or 106*b* therebelow. Once the vertical tracks 208 and 210 are in the lowered position upon full retraction of actuators 271 and 272, the carriage 202 with the pod 204 or 206 may be advanced down the proximal and distal vertical tracks 208 and 210 by engagement of the carriage Z-axis motor 244 and transmission 245 to rotate the pinions 243*a* and 243*b* in the appropriate direction. The carriage 202 is advanced downward until the RSUs 230*a* and 230*b* on pod 204 or 206 connected to carriage 202 engage the rail 106*a* or 106*b*.

Figure 13:
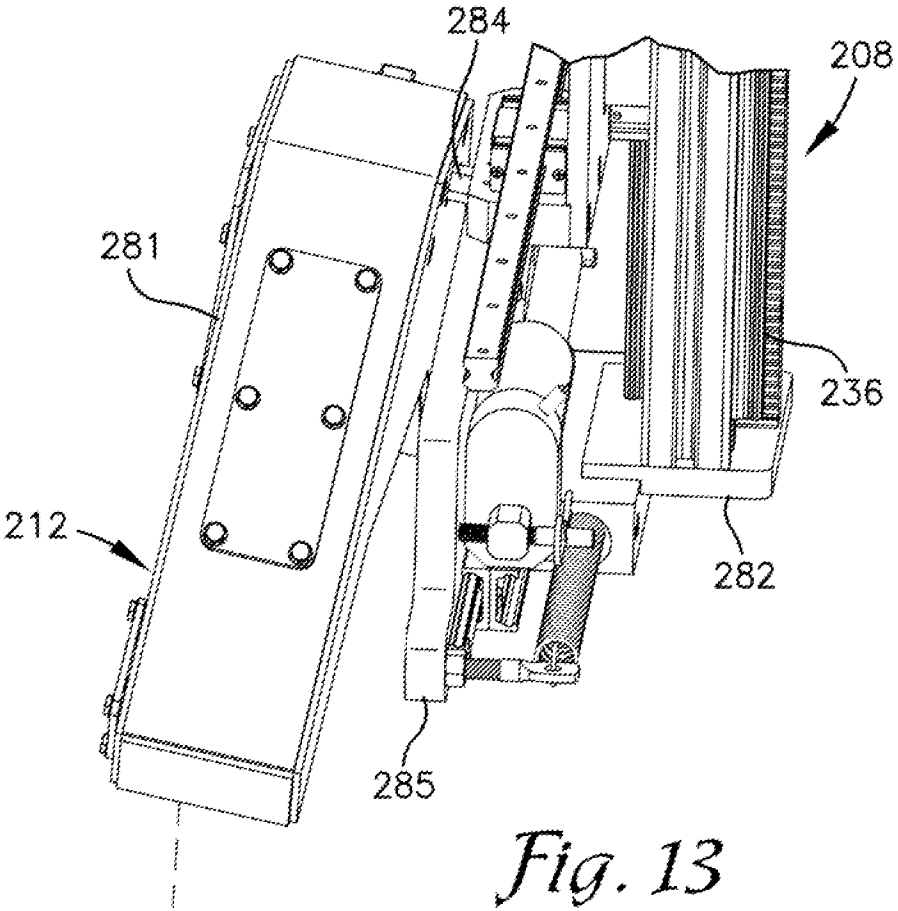
FIG. 13 is a perspective view of the time of flight sensor array of FIG. 12 in a deployed configuration.
Figure 12:
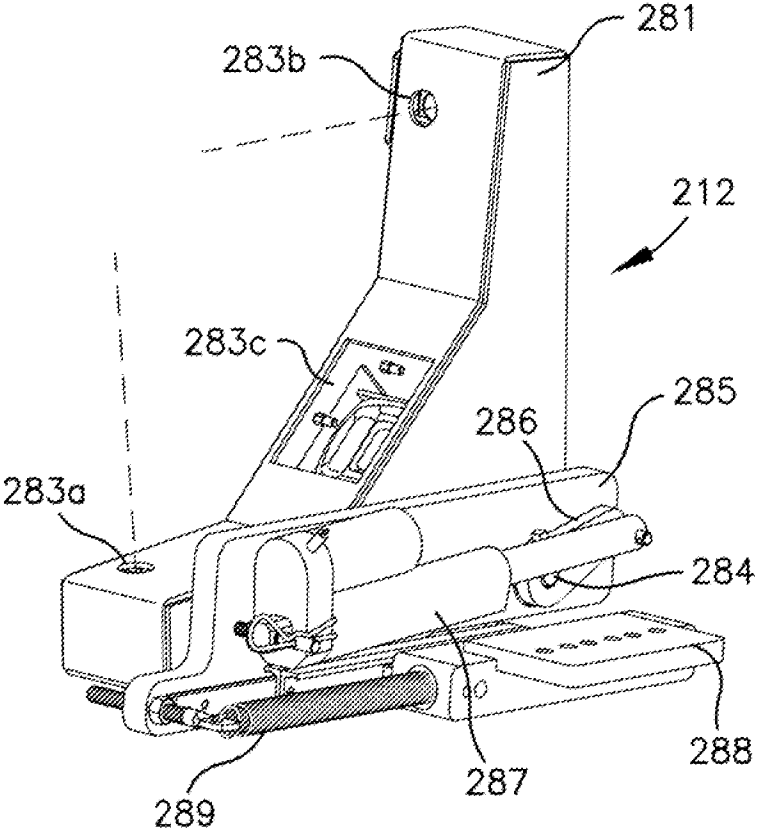
FIG. 12 is a perspective view of a time of flight sensor array in a stowed configuration.

Referring now to FIGS. 12 and 13, the rail centering sensor system 212 is shown in more detail. The sensor system 212 shown includes a sensor housing 281 configured to be pivoted from a storage position (See FIG. 12) to a use position (See FIGS. 13, 28, and 29). While not required, the shape of the sensor housing 281 may generally correspond to the shape of a boomerang, as shown in the figures. The rail centering sensor system 212 is used to determine the center of the head of a rail 106*a* or 106*b* over which the RSUs 230*a* and 230*b* are advanced to adjust the lateral position of the vertical tracks 208 and 210 and the carriage 202 with pod 204 or 206 mounted thereon to maintain the RSUs 230*a* and 230*b* on the pod 204 or 206 over the center of the rails 106*a* or 106*b*.

The pivotable sensor system 212 comprises a TOF sensor 283*a* proximate one end of the sensor housing 281 and a TOF sensor 283*b* proximate the opposite end of the housing 281. As is known, time of flight sensors measure the time it takes for something to travel a distance through a medium. The TOF sensors 283*a* and 283*b* may be optical sensors or other electromagnetic sensors which each emit laser beams or other waves and measure the time these emissions take to reflect off the rail 106*a* and return to the sensors 283*a* and 283*b*. The rail centering sensor system 212 may further comprise a 3D TOF sensor array 283*c*, which, in the embodiment shown, is centered between the TOF sensors 283*a* and 283*b*. The TOF sensors 283*a*, 283*b* and 283*c* may be used to ensure the TOF sensor housing 281 is centered on the rail 106*a* during testing. Where the alignment between the TOF sensor housing 281 and the rail 106*a* is off, the TOF sensors 283*a*, 283*b* and/or 283*c* may so indicate, and corrective action may be taken to realign the TOF sensor housing 281 with the rail 106*a* by adjusting the lateral position of the proximal and distal vertical tracks 208 and 210 to which the rail centering sensor system 212 and the RSUs 230*a* and 230*b* on pod 204 or 206 mounted on carriage 202 are mutually connected. In FIG. 12, the TOF sensor housing 281 is shown in an initial or storage orientation (and for clarity, is shown without the proximal vertical track 208 to which it is coupled). In FIG. 13, conversely, the TOF sensor housing 281 is shown in the operating, use or deployed orientation and coupled to the proximal vertical track 208.

In the embodiment shown, the lower portion of the compartment 108 or 108' is too narrow to house the TOF sensor housing 281 in the operating orientation. The TOF sensor housing is therefore pivotably and slidably mounted relative to the lower end of the proximal vertical track 208. As shown in FIG. 12, the TOF sensor housing 254 of the rail centering sensor system 212 is pivotably mounted on a pivot shaft 284 extending from a center of the housing 281 and through a carrier plate 285. An armature 286 is connected to the pivot shaft 284 and a linear actuator 287 is connected between the carrier plate 285 and the armature 286 and is operable to pivot the TOF sensor housing 281 relative to the carrier plate 285 from a stored orientation to an operating orientation. The carrier plate 285 is slidably mounted on track mounting plate 288 and spring 289 is connected between the carrier plate 285 and the track mounting plate 288 to normally draw the carrier plate 285 and attached TOF sensor housing 281 inward relative to the track mounting plate 288. The track mounting plate 288 is mounted to the bottom of the proximal vertical track 208. When the proximal and distal vertical tracks 208 and 210 are in a deployed position, advanced laterally out of the compartment 108 and then downward, the TOF sensor housing 254 may be rotated from the storage orientation to an operating position by retracting the actuator 287. Before advancing the proximal and distal vertical tracks 208 and 210 upward and inward to a storage position, the actuator 287 is first extended to pivot the TOF sensor housing 281 to the storage orientation. As best seen in FIG. 18, after raising the tracks 208 and 210 vertically, as they are retracted into the compartment inward along the X-axis for storage, an inner end of the carrier plate 285 or the back side of the TOF sensor housing 281 hits a sheet metal portion of the housing before the proximal and distal vertical tracks 208 and 210 are fully retracted into the compartment 108 or 108'. The slidable connection between the carrier plate 285 and the track mounting plate 288 allows the carrier plate 285 and attached TOF sensor housing 254 to slide forward relative to the proximal vertical track 208 as it is further retracted into the compartment 108 or 108'.

When the carriage 202 with the sensor pod (e.g., pod 204) coupled thereto is being used for the ultrasonic testing of a rail, as shown in FIGS. 30-33, the rail centering sensor system 212 is in the operating position and is in line with the RSUs 230*a* and 230*b* on the pod 204. The rail centering sensor system 212 is therefore usable to maintain alignment between the RSUs 230*a* and 230*b* and the rail 106*a*. Specifically, an indication by the TOF sensors 283*a*, 283*b* and/or 283*c* that the TOF sensor housing 254 is misaligned with the rail 106*a* is tantamount to an indication that the RSUs 230*a* and 230*b* are misaligned with the rail 106*a* in the same fashion. The carriage 202 may be caused to move (e.g., inward or outward along the X-axis), by moving the distal and proximal vertical track carriers 251 and 252 inward or outward along the upper and lower horizontal tracks 261 and 262, such that the RSUs 230*a* and 230*b* are properly aligned with the rail 106*a*, which likewise corrects the misalignment between the TOF sensors 283*a*, 283*b* and 283*c* and the rail 106*a*. In the embodiment shown, in the operating position, the TOF sensors 283*a* and 283*b* are oriented to each direct a beam toward the web of the rail 106*a* to determine the relative position of the sensors 283*a* and 283*b* relative to the web of the rail.

As discussed, in the prior art, the flanged wheels associated with the ultrasonic testing carriage must be continuously and manually monitored and the carriage has to be repeatedly recentered on the rails so as to ensure that the RSUs are aligned with the rails. The rail centering sensor system 212 of the embodiment 200 does not require an operator to manually monitor the RSUs throughout the duration of the test to ensure proper rail/RSU alignment. Rather, as soon as the TOF sensors 283*a*, 283*b* and 283*c* indicate that the TOF sensor housing 281 is misaligned relative to the rail 106*a* or 106*b*, the controller 117 (e.g., one or more controllers configured to control operation of the system 200 or 400 housed in the compartment 116 and which may be referred to as a control system) may automatically reorient the proximal and distal vertical tracks 208 and 210 such that the carriage 202, the pod 204 or 206 connected thereto and the RSUs 230*a* and 230*b* connected to the pod 204 and the TOF sensor housing 281 are aligned with the rail 106*a*. The second ultrasonic rail testing apparatus 400 operates independent of ultrasonic rail testing apparatus 200 such that the proximal and distal vertical tracks 208 and 210 and the carriage 202, pod 204 or 206 and RSUs 230*a* and 230*b* connected thereto of testing apparatus 400 are aligned relative to rail 106*b* in response to the position of the proximal vertical track 208 determined by the rail centering sensor system 212 mounted thereon.

A dual-acting locking assembly 301, as best seen in FIGS. 14-18, is used to selectively connect the primary and secondary sensor pods 204 and 206 to their respective storage holsters 226 and 227 or to the carriage 202. The dual-acting locking assembly 301 includes a pod mounted lock assembly 303 and a carriage mounted lock assembly 305. As best seen in FIG. 18 with respect to the primary sensor pod 204, one of the pod mounted lock assemblies 303 is fixedly mounted on each of the primary and secondary sensor pods 204 and 206. The pod mounted locking assembly 303 has been removed from the pod 204 shown in FIG. 10. The carriage mounted lock assembly 305 is fixedly mounted on the carriage 202.

The pod mounted lock assembly 303 includes a latch 307 pivotably mounted on a holster facing side or wall 309 of the pod mounted lock assembly 303. The latch 307 is sized to be received in a latch receiving slot or latch receiver 311 formed in an upper surface of each holster 226 and 227. The latch 307 is normally biased to a latched position by spring 317 extending between an abutment 318 on the holster facing wall 309 of the pod mounted lock assembly 303 and a latch lever arm 315. A socket 321 with an upturned rim 323 forming a ball receiving recess 325 is formed on a side of the pod mounted lock assembly 303 opposite the latch 307 and functions as a first, carriage locking feature. A second, carriage locking feature is incorporated into the carriage mounted lock assembly 305 and cooperates with the first, carriage locking feature to removably couple the pod 204 or 206 to the carriage 202 and to pivot the latch 307 upward out of the latch receiver 311 to allow separation of the pod 204 or 206 from the holster 226 or 227.

The first and second carriage locking features may comprise a ball lock or ball detent type lock. In the embodiment shown, the carriage mounted lock assembly 305 includes a ball carrier 331 with a bore extending therethrough and a plurality of ball bearings 333 positioned in receivers extending radially outward through a reduced diameter neck 335 formed on the leading end of the ball carrier 331. A plunger 337 with an outwardly and rearwardly sloped, peripheral cam surface 339 extends into the bore of the ball carrier 331 with the peripheral cam surface 339 facing toward the ball bearings 333. The plunger 337 is threadingly coupled to a threaded shaft 341 of a plunger motor 343 mounted on a side of the ball carrier 331 opposite the neck 335.

When the carriage 202 is advanced laterally into engagement with one of the pods 204 or 206, the neck 335 of the ball carrier 331 advances into the socket 321 of the pod mounted lock assembly 303. Extension of the plunger 337 toward the ball bearings 333, by operation of plunger motor 343 to rotate threaded shaft 341, advances the peripheral cam surface 339 toward and into engagement with the ball bearings 333 extending through the inner ends of the receivers in the neck 335, forcing the ball bearings 333 outward relative to the neck 335 so that portions of the ball bearings 333 extend into the ball receiving recess 325 of the socket 321. With cam surface 339 of plunger 331 holding the ball bearings 333 in the outward extended position relative to the neck 335 and socket recess 325, abutment of the socket rim 323 against the outwardly extending ball bearings 333 prevents pulling the carriage mounted lock assembly 305 away from the pod mounted lock assembly 303, coupling the pod 204 or 206 to the carriage 202.

When the plunger 337 is advanced by motor 343 and threaded shaft 341 into the bore of the ball carrier 331 into engagement with the ball bearings 333, securing the carriage 202 to the pod 204 or 206, the leading face of the plunger 337 engages the latch lever arm 315 and presses the lever arm 315 outward against the biasing force of the spring 317 to pivot the latch to a raised position out of the latch receiver 311, to allow separation of the pod 204 or 206 from the holster 226 or 227.

When the plunger 337 is retracted within the bore of the ball carrier 331, the cam surface 339 is advanced away from the ball bearings 333 allowing the socket rim 323 to drive the ball bearings inward as the carriage mounted lock assembly 305 is advanced away from the pod 204 or 206 and the pod mounted lock assembly 303 thereby allowing the socket rim 323 to advance past the ball bearings 333 so that the carriage 202 may separate from the pod 204 or 206. As the leading face of the plunger 337 is drawn away from the pod face of the pod mounted lock assembly 303 and the latch lever arm 315, spring 317 biases the latch lever arm 315 rearward, pivoting the latch downward toward a latching or latched position in the latch receiver 311 to hold the pod 204 or 206 to its associated holster 226 or 227 as the carriage 202 is uncoupled from the pod 204 or 206.

Figure 14:
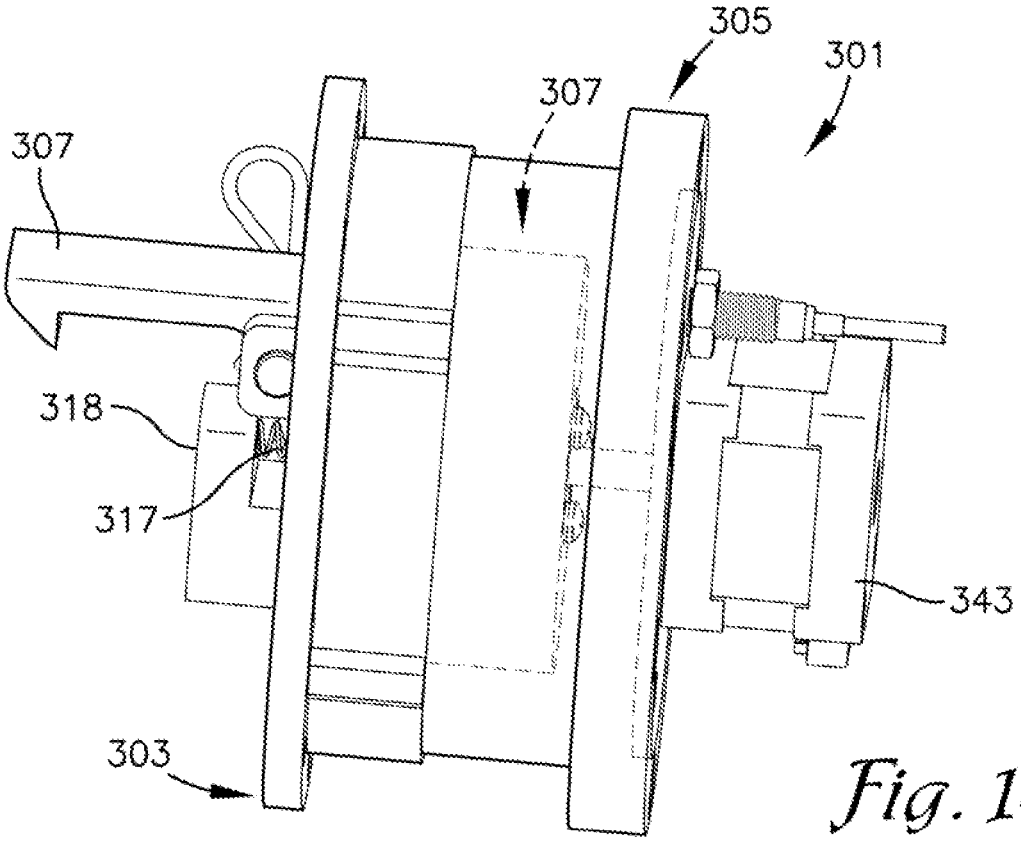
FIG. 14 is a perspective view showing a dual-purpose locking mechanism forming part of the rail testing apparatus of FIG. 4 in which a plunger of a carriage mounted portion of the mechanism is released from a pod mounted portion and a latch for securing the pod to a holster is pivoted to a latched position.
Figure 15:
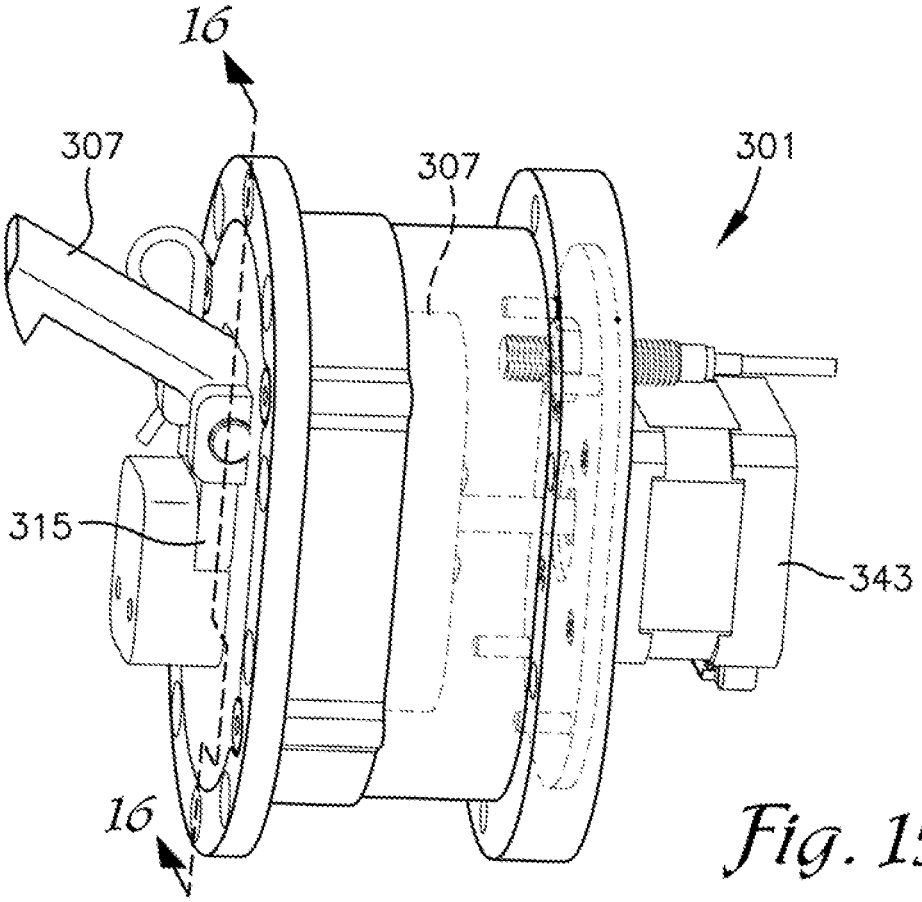
FIG. 15 is a perspective view of the dual-purpose locking mechanism as in FIG. 14 showing the plunger of the carriage mounted portion is engaging the pod mounted portion and the latch is in an unlatched position.
Figure 16:
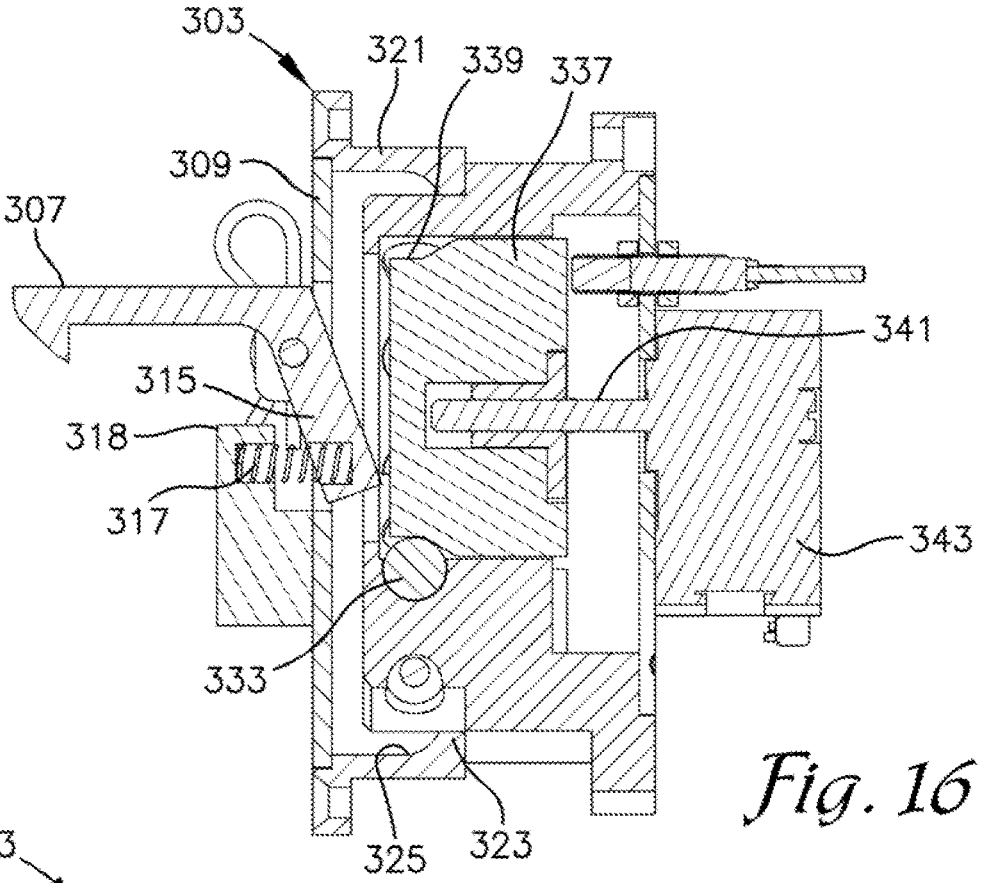
FIG. 16 is a cross-sectional view of the dual-purpose locking mechanism taken generally along line 16-16 of FIG. 15.
Figure 17:
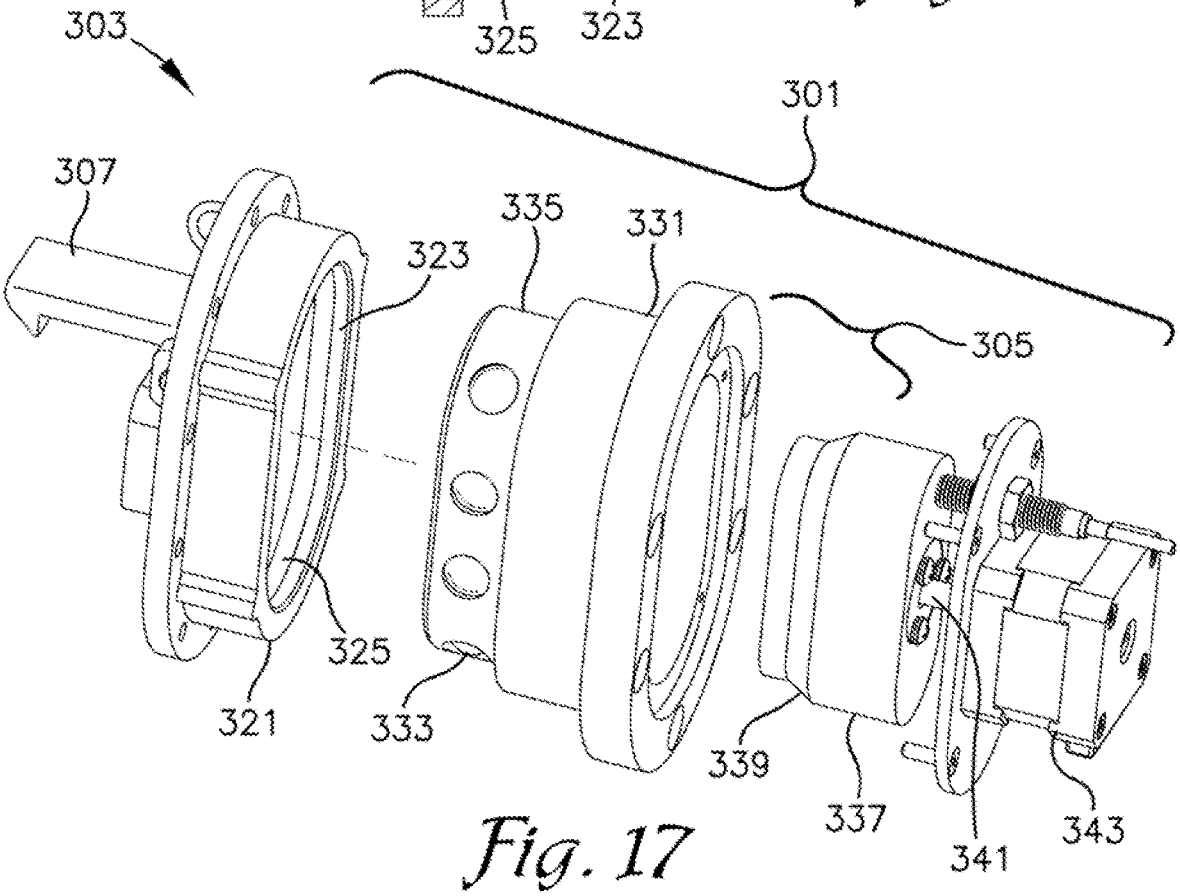
FIG. 17 is an exploded view of the dual-purpose locking mechanism.

FIGS. 14, 16 and 17 show the dual-acting locking assembly 301 in a pod storage state. In this configuration: (a) the latch 307 is in a latched position; and (b) the second, carriage locking feature on the carriage mounted locking assembly 305 is retracted relative to or disengaged from the first, carriage locking feature on the pod mounted locking assembly 303. The latch 307 in the latched position, secures or locks the pod 204 or 206 to its holster 226 or 227 respectively while the carriage 202 is disengaged, uncoupled or unlocked from the pod 204 or 206. FIG. 15 shows the dual-acting locking assembly 301 in a pod operating state. In this configuration: (a) the pod mounted locking assembly 303 is coupled to the carriage mounted locking assembly 305 to lock or couple the carriage 202 to the pod 204 or 206; and (b) the latch 307 is pivoted upward to allow uncoupling of the pod 204 or 206 from its holster 226 or 227 respectively. In embodiments, the locking elements or features of the dual-acting locking assembly 301 may be actuated remotely such as hydraulically, pneumatically or electronically.

Figure 19:
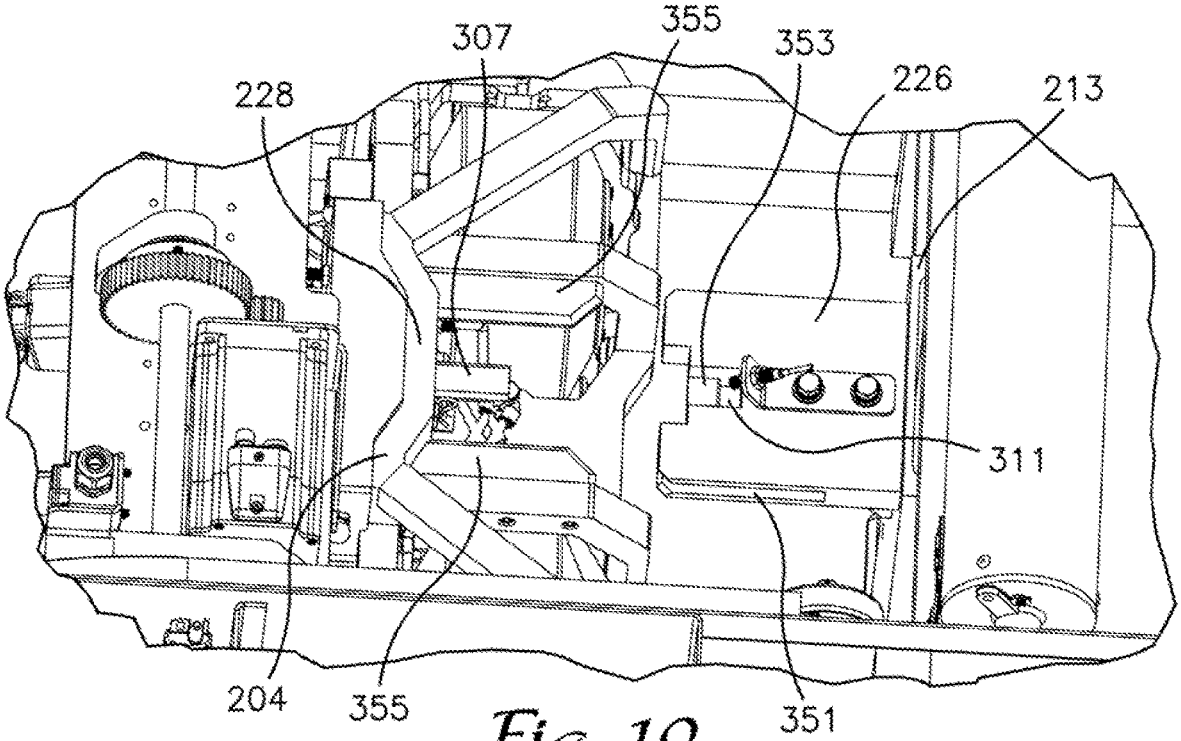
FIG. 19 is a fragmentary perspective view showing one of the pods separated from a holster.

FIGS. 18-20 illustrate the locking or latching and unlocking or unlatching of the pod 204 to holster 226. Referring to FIG. 19, the holster 226 shown, is formed as a rectangular block mounted on the testing apparatus frame 213 and includes grooves or recesses 351 formed along sides of the holster 226 and the latch receiver 311 with a locking shoulder 353 is formed in an upper surface of the holster 226 adjacent a distal end opposite connection of the holster 226 to the support frame 213. Tongues or projections 355 are mounted on each pod 204 and 206 and configured and positioned to be received in the recesses 351 when the pod 204 or 206 is advanced toward the holster 226 or 227. When the pod 204 or 206 is to be stored, the latch 307 may be locked against a locking shoulder 353 of the holster 272 after the projections 355 of the pod frame 228 have been received in the recesses 351 of the holster 272. When the pod 204 is to be used for testing, the carriage 202 may be locked to the pod 204 via the dual-purpose locking mechanism 301. Locking of the carriage 202 and the pod 204 via the dual-purpose locking mechanism 301, causes the latch 307 to pivot out of latch receiver 311 allowing the pod 204 to be separated from the holster 272.

In embodiments, a disc brake 357 (FIG. 21) may be provided on the transmission 245 on carriage 202 to maintain the carriage 202 at a selected height relative to the proximal and distal vertical tracks 208 and 210. Use of the disc brake 357 reduces stress on the motor in trying to maintain the carriage 202 and the pod 204 or 206 coupled thereto at the selected height.

The ultrasonic rail testing apparatus 200 may include homing devices to ensure that the RSU probes 230*a* and 230*b* and the TOF sensors 283*a*, 283*b* and 283*c* have a homing or "zero" point with respect to which relative movement is subsequently made to alter the position of the RSUs. For example, the ultrasonic rail testing apparatus 200 may have a horizontal homing point sensor 360 (FIG. 22) that demarcates the outermost point along the X-axis (i.e., the field side) the carriage 202 is allowed to travel to. Similarly, the ultrasonic rail testing apparatus 200 may have a vertical homing point sensor 362 (FIG. 23) that demarcates the uppermost point along the Z-axis the carriage is allowed to reach. The ultrasonic rail testing apparatus 200 may be homed or zeroed in each of the vertical and the horizontal directions prior to use of the carriage 202 and the pod 204 coupled thereto for testing of the rail 106*a*.

The artisan will understand that the embodiments of the ultrasonic rail testing apparatus 200 disclosed herein may include or have associated therewith electronics (e.g., a computing system comprising transitory and/or non-transitory memory, data servers, one or more processors, etc.), which may, e.g., be housed in compartment 116 and which are represented schematically at 117. The electronics may be used to control and modify the operation of the various components of the ultrasonic rail testing apparatus 200 (e.g., direct motor and/or actuator function). In some example embodiments, processor or processors may be configured through particularly configured hardware, such as an application specific integrated circuit (ASIC), field-programmable gate array (FPGA), etc., and/or through execution of software to allow the ultrasonic rail testing apparatus 200 to function in accordance with the disclosure herein without departing from the scope of the invention. Likewise, the ultrasonic rail testing apparatus 200 may make use of a graphical user interface, or other kind of machine-to-human interface, to carry out embodiments of the functions and features described herein. The processor may include any processor used in smartphones and/or other computing devices, including an analog processor (e.g., a Nanocarbon-based processor). In certain embodiments, the processor may include one or more other processors, such as one or more microprocessors, and/or one or more supplementary co-processors, such as math co-processors.

Figure 34:
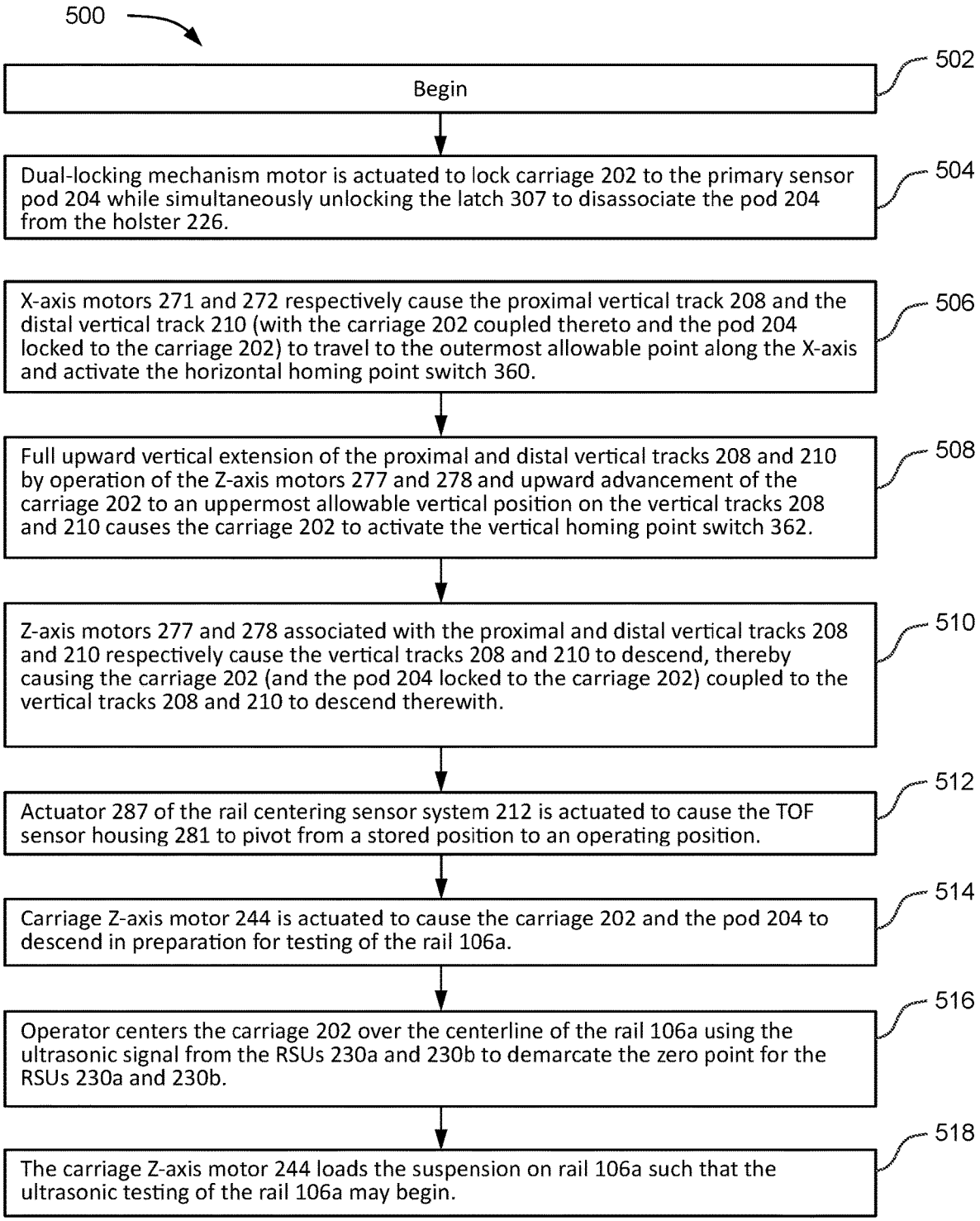
FIG. 34 is flowchart showing steps of a method of operating a rail testing apparatus.

Attention is directed now to FIGS. 22-33 to illustrate example operation of the ultrasonic rail testing apparatus 200, in an embodiment. FIG. 34 is a flowchart outlining a method 500 illustrating these steps for operating the ultrasonic rail testing apparatus 200. Unless outlined herein, these steps are carried out autonomously or generally autonomously using one or more processors and machine-readable instructions executed thereby. The method 500 begins with the pod 204: (a) locked to the holster 272 via the latch 307; and (b) unlocked from the carriage 202.

The method 500 may begin at step 502. At step 504, the dual-purpose locking mechanism 301 (FIGS. 14-17) may be actuated using plunger motor 343 to cause the carriage mounted locking assembly 305 to engage and secure the pod mounted locking assembly 303 thereto to lock the carriage 202 to the primary sensor pod 204 while simultaneously resulting in the latch 307 pivoting to an unlatched position releasing or unlocking the primary sensor pod 204 from the holster 272.

Figure 22:
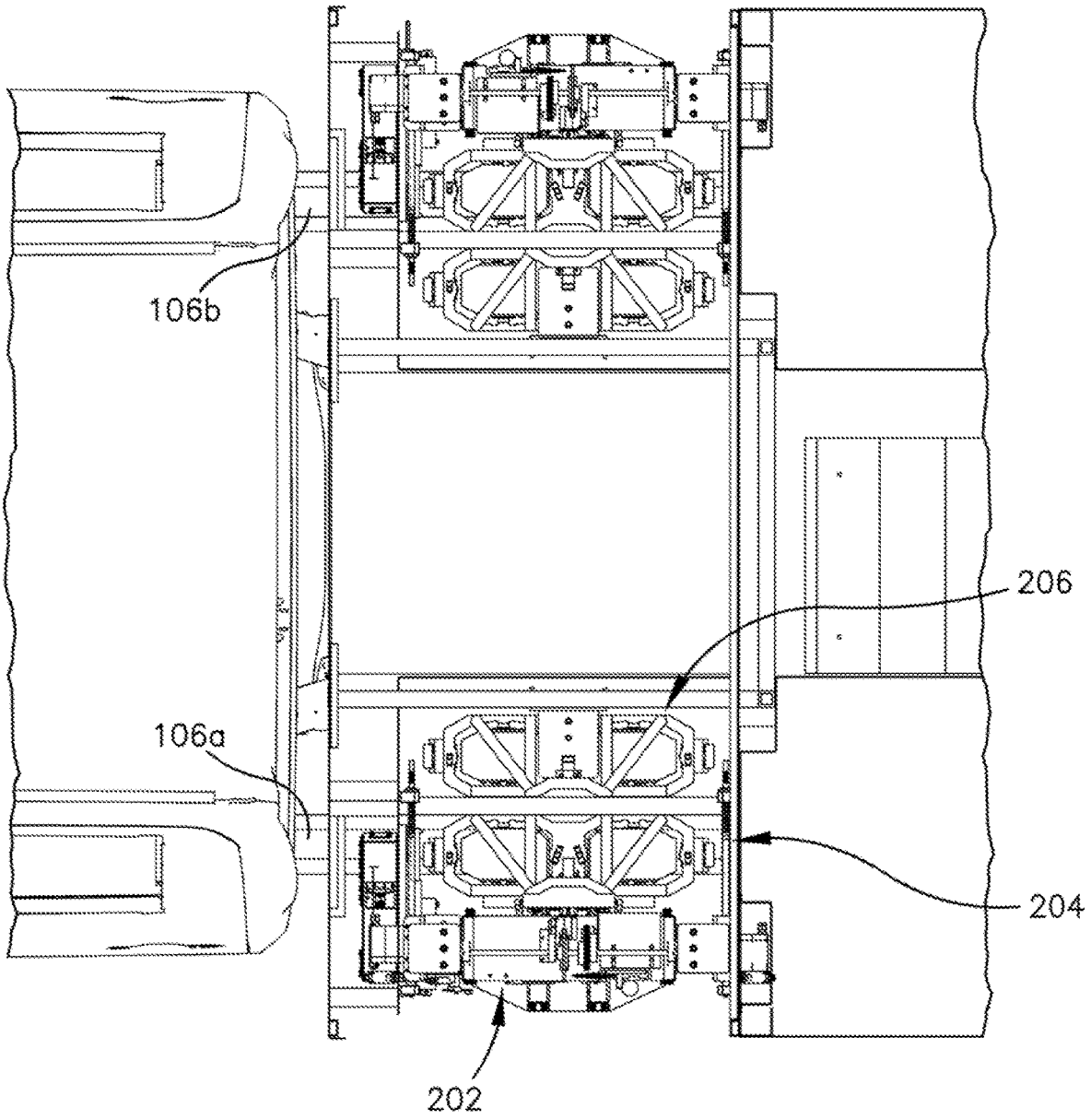
FIG. 22 is a top view of the rail testing system on a hi-rail vehicle as in FIG. 2 with portions of the equipment housing removed.
Figure 23:
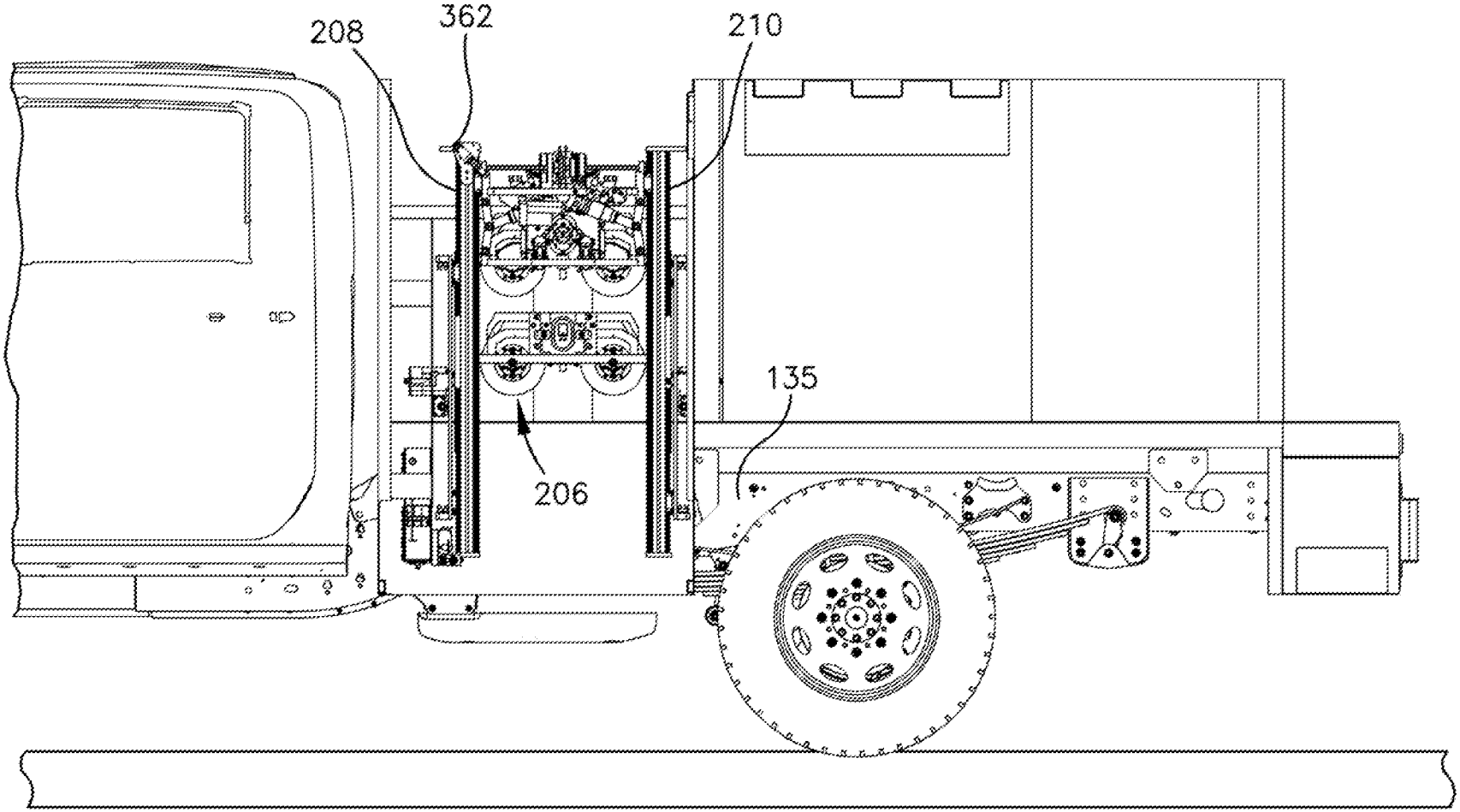
FIG. 23 is a side view of the rail testing system on a hi-rail vehicle as in FIG. 2 with portions of the equipment housing removed.
Figure 25:
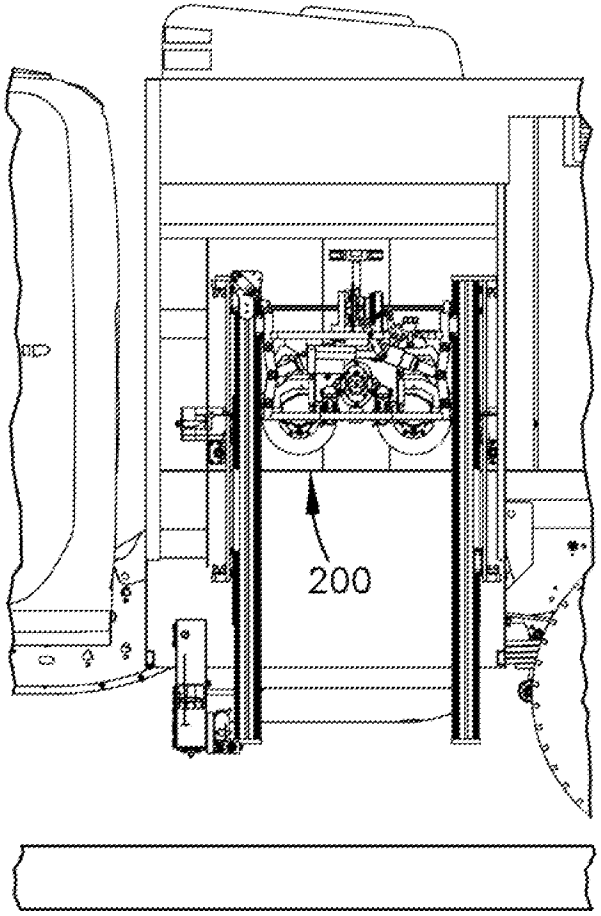
FIG. 25 is a partial side view of the rail testing system of FIG. 2 in process of changing between a storage and an operational configuration.
Figure 24:
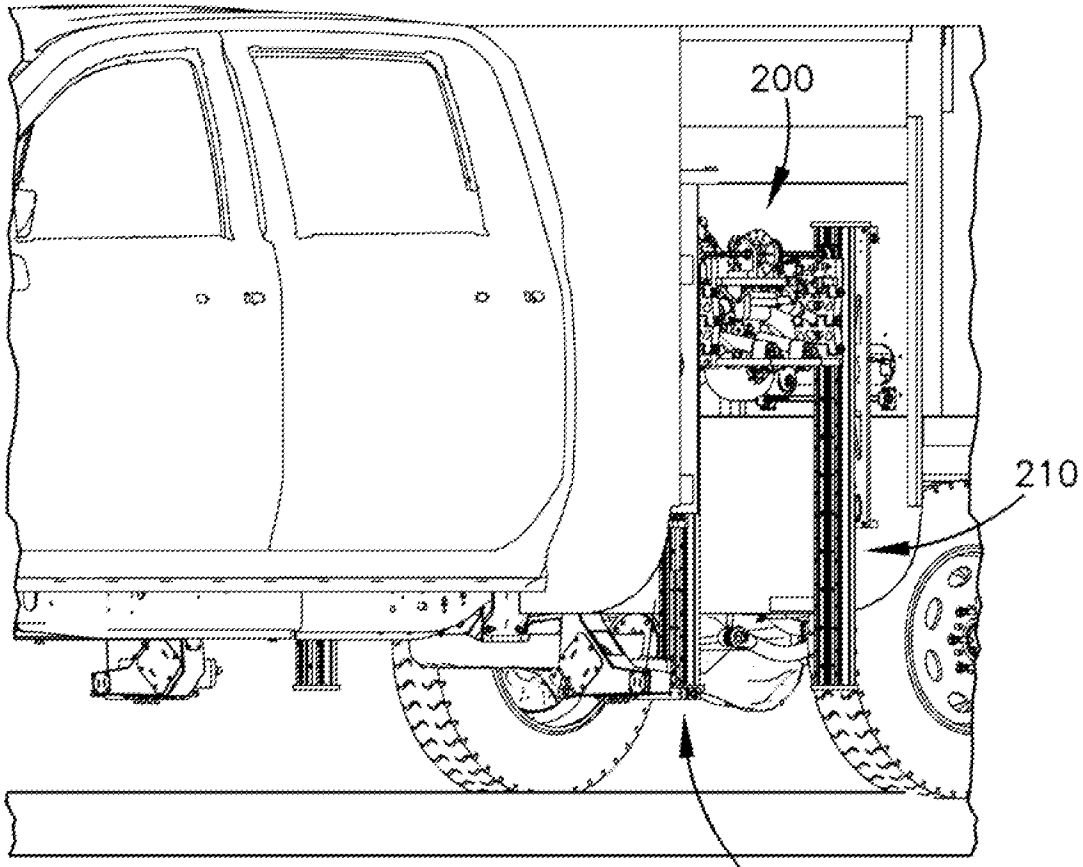
FIG. 24 is a partial side perspective view of the rail testing system of FIG. 2 in process of changing between a storage and an operational configuration.
Figure 27:
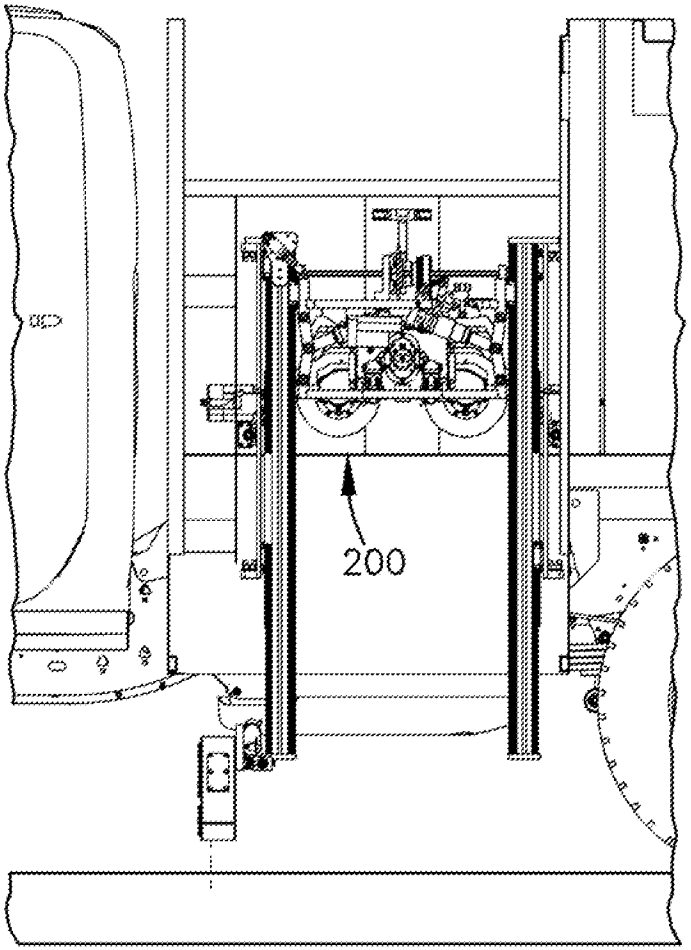
FIG. 27 is a partial side view of the rail testing system of FIG. 2 at a more advanced stage of the process of changing between a storage and an operational configuration compared to FIG. 25.
Figure 26:
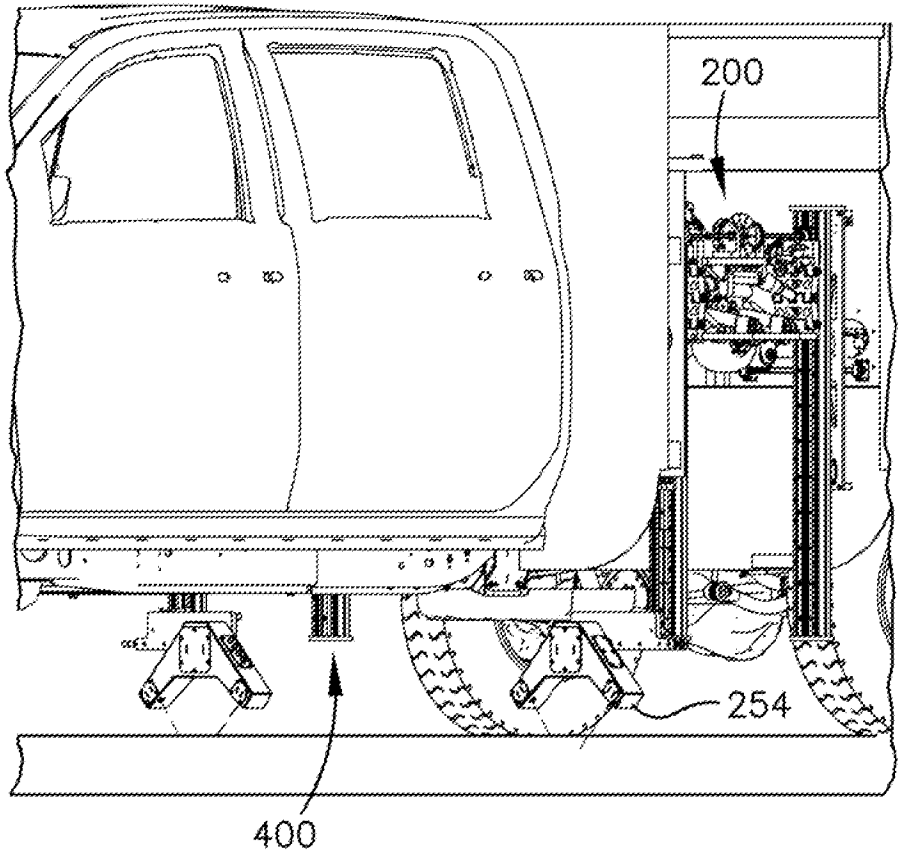
FIG. 26 is a partial side perspective view of the rail testing system of FIG. 2 at a more advanced stage of the process of changing between a storage and an operational configuration compared to FIG. 24.
Figure 29:
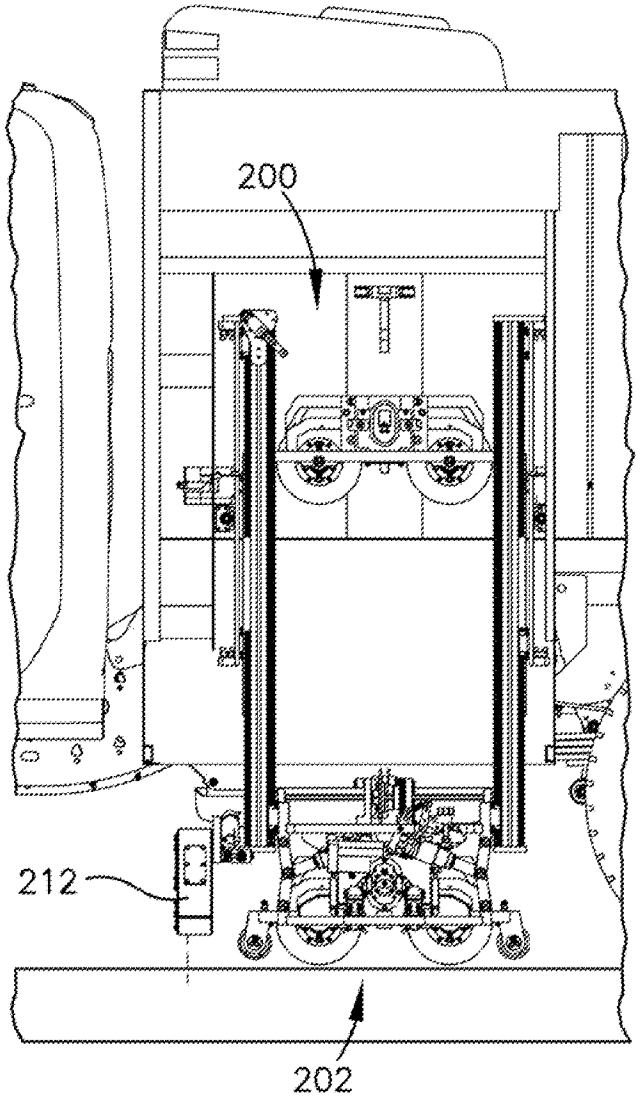
FIG. 29 is a partial side view of the rail testing system of FIG. 2 at a more advanced stage of the process of changing between a storage and an operational configuration compared to FIG. 27.
Figure 28:
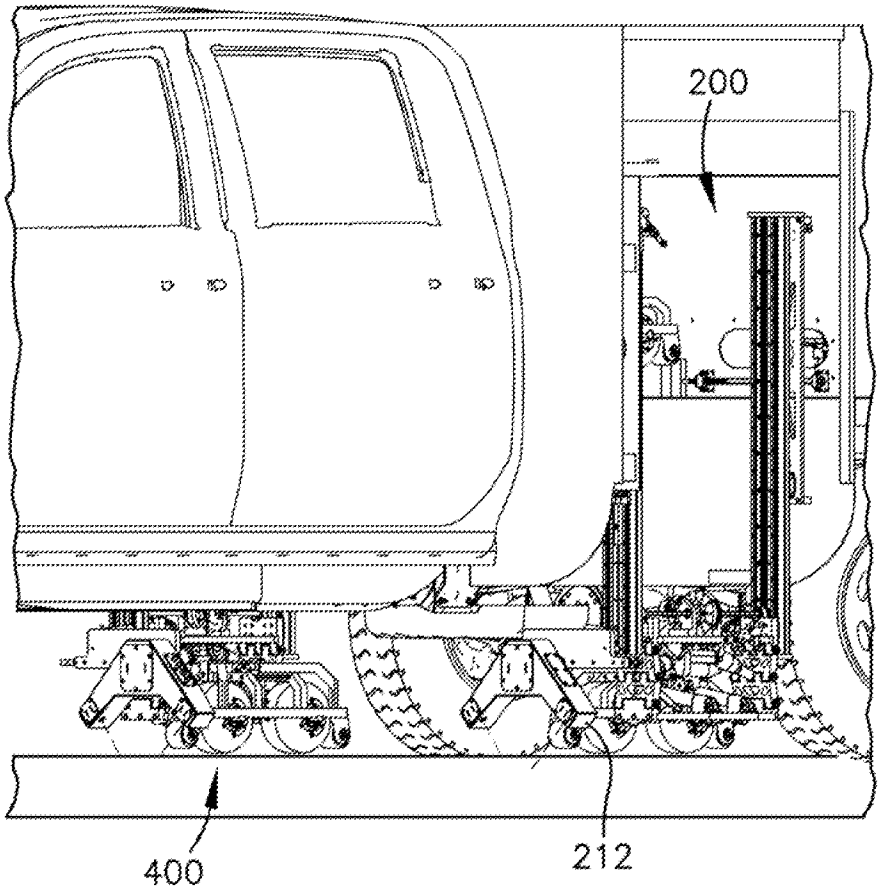
FIG. 28 is a partial side perspective view of the rail testing system of FIG. 2 at a more advanced stage of the process of changing between a storage and an operational configuration compared to FIG. 26.
Figure 31:
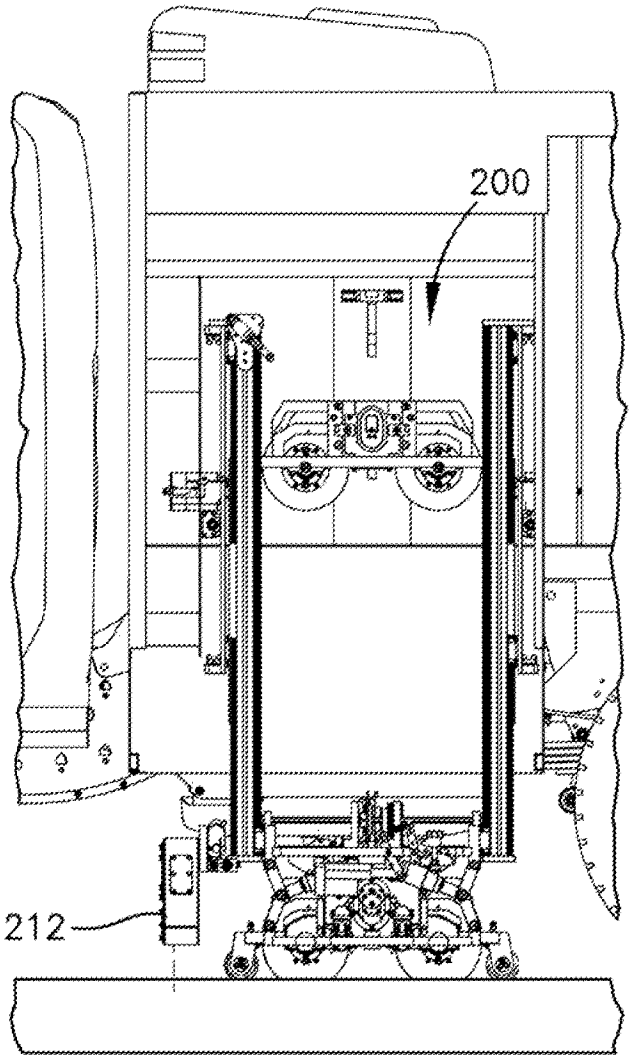
FIG. 31 is a partial side view of the rail testing apparatus of FIG. 2 in an operational configuration.
Figure 30:
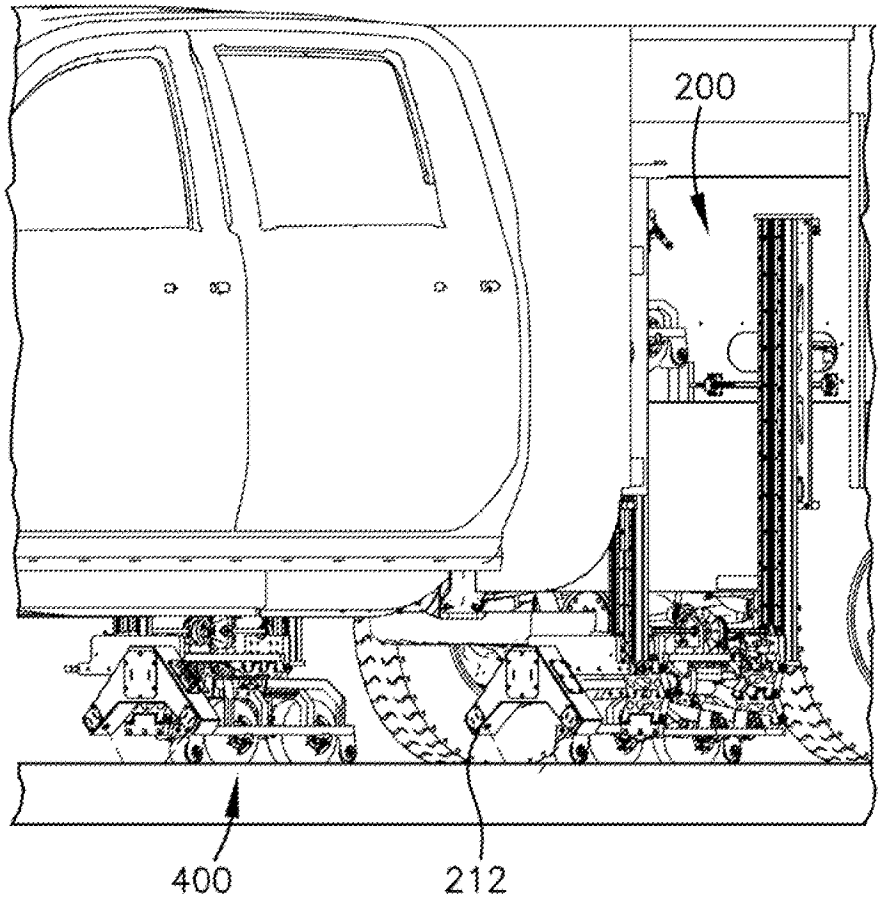
FIG. 30 is a partial side perspective view of the rail testing apparatus of FIG. 2 in an operational configuration.
Figure 32:
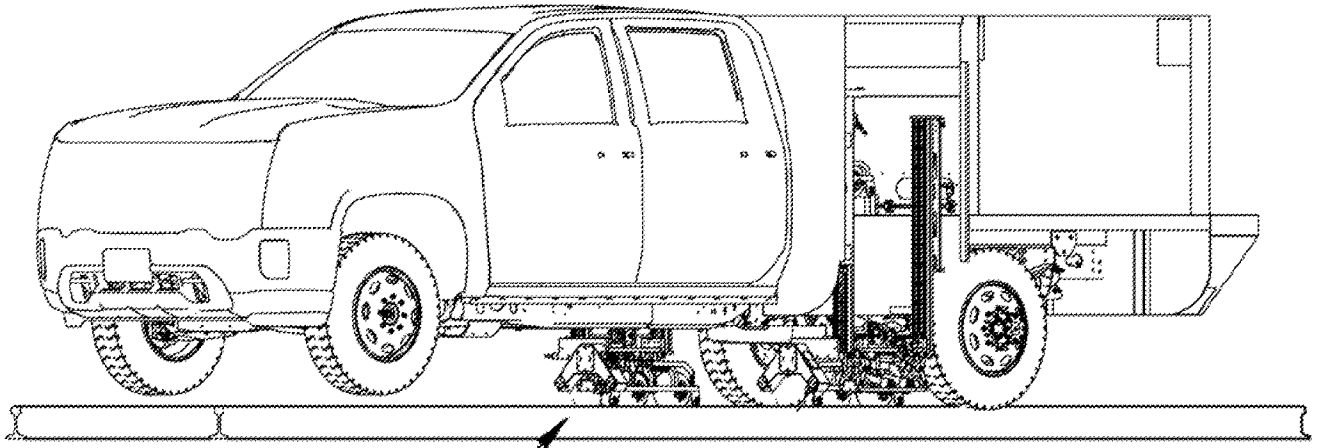
FIG. 32 is a side perspective view of the rail testing apparatus on a hi-rail vehicle as in FIG. 2 in an operational configuration.

At steps 506 and 508, the ultrasonic rail testing apparatus 200 may be zeroed in the horizontal and vertical directions (or vice versa). Specifically, at step 506 (FIG. 22), the horizontally oriented, proximal and distal linear actuators 277 may respectively cause the proximal and distal, vertical tracks 208 and 210 (with the carriage 202 coupled thereto and the pod 204 locked to the carriage 202) to travel to the outermost allowable point along the X-axis (the field side) and activate the horizontal homing point switch 360 (FIG. 22). Similarly, at step 508 (FIG. 23), the vertically oriented, proximal and distal linear actuators 271 and 272 may be operated to raise the proximal and distal vertical tracks 208 and 210 to a fully raised alignment and the carriage Z-axis motor 244 (see FIG. 4 and FIG. 9) may cause the carriage 202 to travel on the vertical tracks 208 and 210 to the upper most allowable point on the Z-axis to activate the vertical homing point switch 362 (FIG. 23).

At step 510 (FIGS. 24 and 25), the vertically oriented, proximal and distal linear actuators 271 and 272 may cause the proximal and distal vertical tracks 208 and 210 to descend, thereby causing the carriage 202 (and the pod 204 locked to the carriage 202) coupled to the proximal and distal vertical tracks 208 and 210 to descend therewith.

At step 512 (FIGS. 26 and 27), the actuator 287 (FIG. 12) of the rail centering sensor system 212 may be actuated to cause the TOF sensor housing 281 to pivot from the stored position (FIG. 12) to the operating position (FIGS. 13 and 26-33).

At step 514 (FIGS. 28 and 29), the carriage Z-axis motor 244 may be actuated to cause the carriage 202 and the pod 204 to descend in preparation for testing of the rail 106*a*.

At step 516 (FIGS. 30 and 31), the operator may center the carriage 202 over the centerline of the rail 106*a* using the ultrasonic signal from the RSUs 230*a* and 230*b* and the X-axis motors or actuators 271 and 272 to move the vertical tracks 208 and 210 along the X-axis. This point may serve as the zero point for the RSUs 230*a* and 230*b*. This step may need to be carried out only once (e.g., during initial setup at the start of testing each day), as thereafter, the system 200 may take over to maintain alignment of the RSUs 230*a* and 230*b* and the rail 106*a* autonomously.

At step 518 (FIGS. 32 and 33), the carriage Z-axis motor 244 may load the suspension on rail 106*a* such that the ultrasonic testing of the rail 106*a* may begin. The artisan will understand that the ultrasonic rail testing apparatus 400 for testing the rail 106*b* may be configured for testing the rail 106*b* in much the same way.

The hi-rail vehicle 104 may now drive on the rails 106*a* and 106*b* on its flanged wheels. Any float in these flanged wheels may be automatically corrected by the rail testing apparatus 200 and/or 400 such that the RSUs thereof remain centered on the rails 106*a* and 106*b* for the duration of the test with the X-axis motors or actuators 271 and 272 operating to move the vertical tracks 208 and 210 to which the carriages 202 and 210 are connected horizontally or along the X-axis to correct for any misalignment as to the positioning of the RSUs relative to the rails 106*a* and 106*b* as detected by the TOF sensors 283*a*, 283*b* and 283*c*. The steps may be reversed to retract the rail testing apparatus 200 and 400 when not in use.

When, for example, the pod 204 is to be stored, the Z-axis motor 244 is operated to raise the vertical tracks 208 and 210 upward and fully into the compartment 108 or 108' and the Z-axis motors 277 and 278 may be operated to raise the carriage 202 on the vertical rails 208 and 210 until the pod 204 is aligned with the upper holster 226. The X-axis motors 271 and 272 are operated to draw the vertical tracks 208 and 210 and attached carriage 202 and pod 204 toward the holster 226. Once the projections 355 on pod 204 are fully advanced into the recesses 351 on the sides of the holster 226, the plunger motor 343 of the dual-acting locking assembly 301 is operated to retract the plunger 337 allowing the carriage mounted lock assembly 305 to separate from the pod mounted lock assembly 303 and allowing the spring 317 to bias the latch 307 into the latch receiving recess 311 in the holster 226 securing the pod thereto.

To move the carriage 202 to connect to pod 206, the X-axis motors 271 and 272 may then be operated to move the vertical tracks 208 and 210 and attached carriage 202 away from the holster 226 and the pod 204 attached thereto. The Z-axis motor 244 may then be operated to advance the carriage 202 into alignment with the pod 206 mounted on holster 227. The X-axis motors 271 and 272 are operated to move the vertical tracks 208 and 210 and the attached carriage 202 toward pod 206 until the carriage mounted lock assembly 305 extends into the pod mounted lock assembly 303. The plunger motor 343 is operated to extend the plunger 337 securing the carriage mounted lock assembly 305 to the pod mounted lock assembly 303 by forcing the ball bearings 333 outward into the recess 325 of socket 321 of pod mounted lock assembly 303. Extension of the plunger 337 pivots the latch 307 upward and out of the latch receiving recess 311 in holster 227. the X-axis motors 271 and 272 may then be operated to move the vertical tracks 208 and 210, along with the carriage 202 and pod 206 attached thereto away from the holster 227. The steps starting with step 506 may then be repeated to deploy the RSUs on the pod 206.

It is foreseen that other types of sensors could be mounted on or used with the sensor positioning assemblies as described herein to position the sensors in a preferred position relative to a respective rail 106*a* or 106*b* to image or scan a particular portion of the rail to obtain relevant information regarding properties of that portion of the rail. Additional sensor systems which might be used with the sensor positioning assemblies include Eddy current sensors, inductive sensors, LIDAR imaging systems, line vision imaging systems, optical cameras, thermal imaging sensors or others. The sensors or systems could be used for track geometry measurement, rail profile measuring, joint bar inspection, rail surface imaging, rail flaw detection, ballast profiling for profiling the amount of ballast around rail ties on which the rails are mounted. It is foreseen that different types of sensors could be incorporated into the separate pods 204 and 206 such that sensor pod 204 might include for example, RSUs and pod 206 might include LIDAR imaging sensors to allow each rail property sensing apparatus, such as apparatus 200, may selectively deploy pod 204 with RSUs for rail flaw defect detection or pod 206 with LIDAR imaging sensors to obtain an image of the profile of the rail 106*a*.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A rail sensing system moveable along a railway for sensing one or more properties of a first rail of the railway, the rail sensing system comprising:

a support structure moveable along the first rail;

a first rail property sensor mounted on a carriage, the first rail property sensor sensing one or more properties of a first rail, the carriage moveable relative to the support structure in a substantially vertical direction and a substantially horizontal direction;

a first rail position sensor mounted in a known horizontal spacing relative to the carriage, the first rail position sensor in communication with a control system, the control system in communication with and controlling a first X-axis motor to move the carriage in the substantially horizontal direction to maintain a horizontal alignment of the first rail property sensor relative to the first rail based upon information transmitted from the first rail position sensor to the control system.

2. The rail sensing system as in claim 1, wherein the rail property sensor comprises at least one ultrasonic roller search unit.

3. The rail sensing system as in claim 1, wherein the first position sensor comprises a first time of flight sensor array operable with the controller to maintain the first rail property sensor in a selected alignment relative to a head of the first rail.

4. The rail sensing system as in claim 1, wherein the first position sensor comprises a first time of flight sensor array operable with the controller to maintain the first rail property sensor approximately centered relative to a head of the first rail.

5. The rail sensing system as in claim 1, wherein:

the first rail property sensor is mounted on a first sensor pod which is selectively securable to and releasable from the carriage;

a first holster is connected to the support structure and the first sensor pod is selectively securable to the first holster when released from the carriage.

6. The rail sensing system as in claim 1, further comprising:

a second sensor pod to which a second rail property sensor is mounted; and a second holster connected to the support structure, wherein the second sensor pod is selectively securable to and releasable from the carriage and selectively securable to the second holster when released from the carriage.

7. The rail sensing system as in claim 1 wherein the support structure is mounted on a frame of a hi-rail vehicle.

8. The rail sensing system as in claim 1 wherein the carriage is moveably mounted for movement in the substantially vertical direction on at least one vertical track and the X-axis motor is operably connected to the at least one vertical track for moving the at least one vertical track horizontally.

9. The rail sensing system as in claim 1 wherein the first rail position sensor is mounted on the at least one vertical track proximate a lower end thereof.

10. The rail sensing system as in claim 1 further comprising:

at least one vertical track on which the carriage is moveably mounted for movement in the vertical direction and a carriage Z-axis motor connected between the carriage and the at least one vertical track for moving the carriage in the vertical direction on the at least one vertical track wherein the X-axis motor is operably connected to the at least one vertical track for moving the at least one vertical track horizontally; and at least one vertical track carrier on which the at least one vertical track is mounted for movement in the vertical direction and a vertical track Z-axis motor connected between the at least one vertical track carrier and the at least one vertical track for moving the at least one vertical track vertically relative to the vertical track carrier.

11. A rail sensing system moveable along a railway for sensing one or more properties of first and second rails of the railway, the rail sensing system comprising:

a support structure moveable along the first and second rails;

a rail property sensor mounted on a first carriage, the first rail property sensor communicating with a control system to determine one or more properties of a first rail;

the first carriage mounted on a first carriage positioning assembly, the first carriage positioning assembly including a first X-axis motor operable to move the carriage horizontally relative to the support structure and a first Z-axis motor operable to move the first carriage vertically relative to the support structure;

a first rail position sensor mounted in a known horizontal spacing relative to the first carriage, the first rail position sensor in communication with a control system, the control system in communication with and controlling a first X-axis motor to move the first carriage in the substantially horizontal direction to maintain a horizontal alignment of the first rail property sensor relative to the first rail based upon information transmitted from the first rail position sensor to the control system;

a second rail property sensor mounted on a second carriage, the second rail property sensor communicating with a control system to determine one or more properties of a second rail;

the second carriage mounted on a second carriage positioning assembly, the second carriage positioning assembly including a second X-axis motor operable to move the second carriage horizontally relative to the support structure and a second Z-axis motor operable to move the second carriage vertically relative to the support structure; and a second rail position sensor mounted in a known horizontal spacing relative to the second carriage, the second rail position sensor in communication with a control system, the control system in communication with and controlling a second X-axis motor to move the second carriage in the substantially horizontal direction to maintain a horizontal alignment of the second rail property sensor relative to the second rail based upon information transmitted from the second rail position sensor to the control system.

12. The rail sensing system as in claim 11, wherein the first and second rail property sensors each comprise at least one ultrasonic roller search unit.

13. The rail sensing system as in claim 11, wherein the first position sensor array comprises a first time of flight sensor array operable with the controller to maintain the first rail property sensor in a selected alignment relative to a head of the first rail and the second position sensor array comprises a second time of flight sensor array operable with the controller to maintain the second rail property sensor in a selected alignment relative to a head of the second rail.

14. The rail sensing system as in claim 11, wherein the first position sensor array comprises a first time of flight sensor array operable with the controller to maintain the first rail property sensor approximately centered relative to a head of the first rail and the second position sensor array comprises a second time of flight sensor array operable with the controller to maintain the second rail property sensor approximately centered relative to a head of the second rail.

15. The rail sensing system as in claim 11, wherein:

the first rail property sensor is mounted on a first sensor pod which is selectively securable to and releasable from the first carriage;

a first holster is connected to the support structure and the first sensor pod is selectively securable to the first holster when released from the first carriage;

the second rail property sensor is mounted on a second sensor pod which is selectively securable to and releasable from the second carriage;

a second holster is connected to the support structure and the second sensor pod is selectively securable to the second holster when released from the second carriage.

16. The rail sensing system as in claim 11 wherein the support structure is mounted on a frame of a hi-rail vehicle.

17. The rail sensing system as in claim 11 wherein:

the first carriage is moveably mounted for movement in the substantially vertical direction on at least one first vertical track and the first X-axis motor is operably connected to the at least one first vertical track for moving the at least one first vertical track horizontally; and the second carriage is moveably mounted for movement in the substantially vertical direction on at least one second vertical track and the second X-axis motor is operably connected to the at least one second vertical track for moving the at least one second vertical track horizontally.

18. The rail sensing system as in claim 11 wherein:

the first rail position sensor is mounted on the first vertical track proximate a lower end thereof; and the second rail position sensor is mounted on the second vertical track proximate a lower end thereof.

19. The rail sensing system as in claim 11 further comprising:

at least one first vertical track on which the first carriage is moveably mounted for movement in the vertical direction and a first carriage Z-axis motor connected between the first carriage and the at least one first vertical track for moving the first carriage in the vertical direction on the at least one first vertical track wherein the first X-axis motor is operably connected to the at least one first vertical track for moving the at least one first vertical track horizontally; and at least one first vertical track carrier on which the at least one first vertical track is mounted for movement in the vertical direction and a first vertical track Z-axis motor connected between the at least one first vertical track carrier and the at least one first vertical track for moving the at least one first vertical track vertically relative to the first vertical track carrier at least one second vertical track on which the second carriage is moveably mounted for movement in the vertical direction and a second carriage Z-axis motor connected between the second carriage and the at least one second vertical track for moving the carriage in the vertical direction on the at least one second vertical track wherein the second X-axis motor is operably connected to the at least one second vertical track for moving the at least one second vertical track horizontally; and at least one second vertical track carrier on which the at least one second vertical track is mounted for movement in the vertical direction and a second vertical track Z-axis motor connected between the at least one second vertical track carrier and the at least one second vertical track for moving the at least one second vertical track vertically relative to the second vertical track carrier.

20. An apparatus for detecting flaws in first and second rails of a railway, the apparatus being mountable to a hi-rail vehicle frame of a hi-rail vehicle and comprising:

a support structure connected to the hi-rail vehicle frame;

a first rail imaging system disposed on a left side of the hi-rail vehicle frame, the first rail imaging system comprising:

a left vertical track mounted on a left horizontal track, the left horizontal track connected to the support structure on the left side of the hi-rail vehicle frame; a left vertical track motor operably connected to the left vertical track to move the left vertical track horizontally relative to the support structure;

a left carriage moveably mounted on the left vertical track for vertical movement relative thereto and a left carriage motor connected between the left carriage and the left vertical track and operably moving the left carriage vertically on the left vertical track;

a left rolling rail imaging sensor mounted on the left carriage;

a second rail imaging system disposed on a right side of the hi-rail vehicle frame, the second rail imaging system comprising:

a right vertical track mounted on a right horizontal track, the right horizontal track connected to the support structure on the right side of the hi-rail vehicle frame; a right vertical track motor operably connected to the right vertical track to move the right vertical track horizontally relative to the support structure;

a right carriage moveably mounted on the right vertical track for vertical movement relative thereto and a right carriage motor connected between the right carriage and the right vertical track and operably moving the right carriage vertically on the right vertical track;

a right rolling rail imaging sensor mounted on the right carriage.

21. The apparatus as in claim 20 further comprising a left time of flight sensor array connected to the left vertical track proximate a lower end thereof, the left time of flight sensor array in communication with a control system and the control system in communication with and controlling left vertical track motor to move the left vertical track horizontally to maintain a horizontal alignment of the left rolling rail imaging sensor relative to the first rail based upon information transmitted from the left time of flight sensor array to the control system and a right time of flight sensor array connected to the right vertical track proximate a lower end thereof, the right time of flight sensor array in communication with a control system and the control system in communication with and controlling right vertical track motor to move the right vertical track horizontally to maintain a horizontal alignment of the right rolling rail imaging sensor relative to the second rail based upon information transmitted from the right time of flight sensor array to the control system.

* * * * *